United States Patent [19]

List

[11] 4,455,946

[45] Jun. 26, 1984

[54] ARTICULATED TRUCKS

[75] Inventor: Harold A. List, Bethlehem, Pa.

[73] Assignee: Railway Engineering Associates, Inc., Bethlehem, Pa.

[21] Appl. No.: 948,878

[22] Filed: Oct. 5, 1978

Related U.S. Application Data

[63] Continuation-in-part of Ser. No. 608,596, Aug. 28, 1975, Pat. No. 4,131,069, which is a continuation-in-part of Ser. No. 438,334, Jan. 31, 1974, abandoned.

[51] Int. Cl.[3] ..... B61F 3/08; B61F 5/38; B61F 5/52

[52] U.S. Cl. ..... 105/168; 29/401.1; 105/182 R; 105/224.1; 188/52

[58] Field of Search ..... 105/165, 166, 167, 168, 105/182 R, 199 R, 224.1; 29/401.1, 434

[56] References Cited

U.S. PATENT DOCUMENTS

| | | | |
|---|---|---|---|
| 220,928 | 10/1879 | Marsters | 105/165 |
| 2,296,106 | 9/1942 | Holland et al. | 105/167 |
| 3,528,374 | 9/1970 | Wickens | 105/165 X |
| 3,690,271 | 9/1972 | Hobbs | 105/167 X |
| 3,789,770 | 2/1974 | List | 105/168 |
| 3,862,606 | 1/1975 | Scales | 105/167 |
| 4,003,316 | 1/1977 | Monselle | 105/182 R X |
| 4,067,262 | 1/1978 | Scheffel | 105/168 |
| 4,131,069 | 12/1978 | List | 105/168 |
| 4,134,343 | 1/1979 | Jackson | 105/167 |

FOREIGN PATENT DOCUMENTS

| | | | |
|---|---|---|---|
| 450709 | 1/1972 | Australia | 105/168 X |

*Primary Examiner*—Howard Beltran
*Attorney, Agent, or Firm*—Kenneth P. Synnestvedt

[57] ABSTRACT

A vehicle truck embodying articulated subtrucks or steering arms having a plurality of wheelsets, with steering arm interconnections establishing coordinated steering motions of the wheelsets, the truck also having elastic restraining devices for stabilizing steering and other motions of the wheelsets. A method and structure is provided for adapting or "retrofitting" existing truck structures in a manner to embody the steering and stabilizing characteristics.

17 Claims, 29 Drawing Figures

Fig. 9.
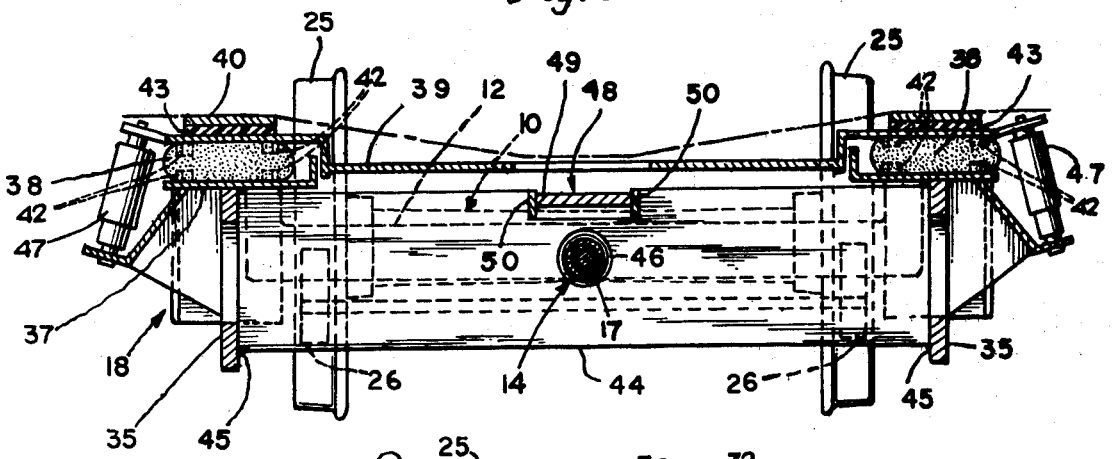
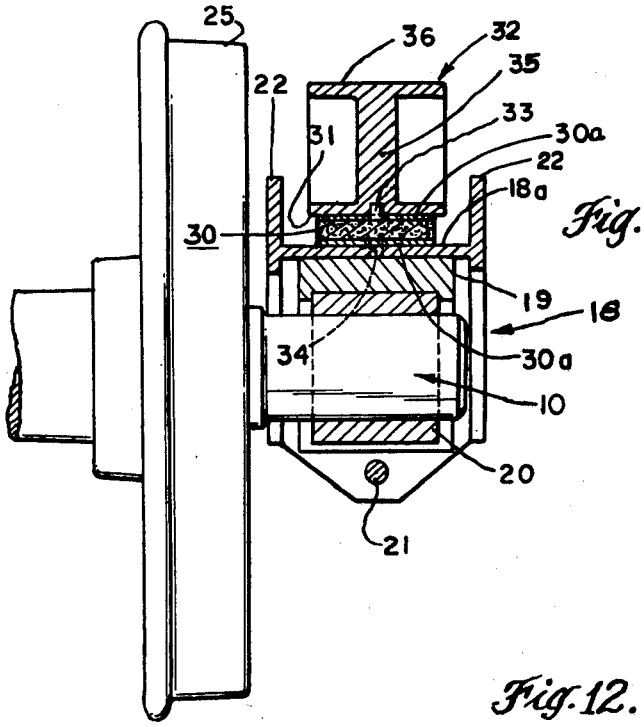
Fig. 10.
Fig. 11.
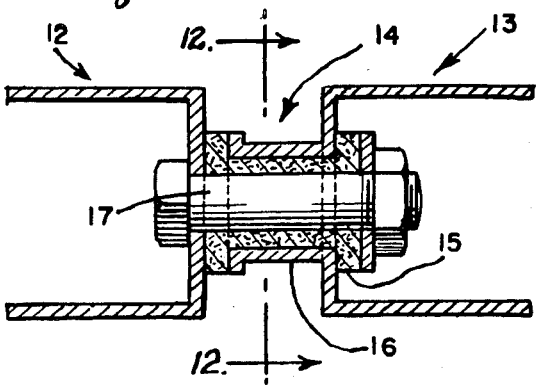
Fig. 12.
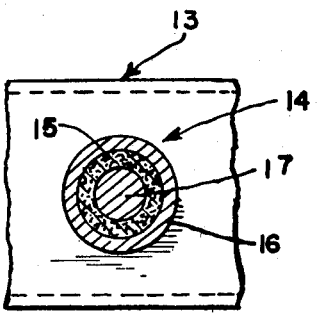

Fig. 13.
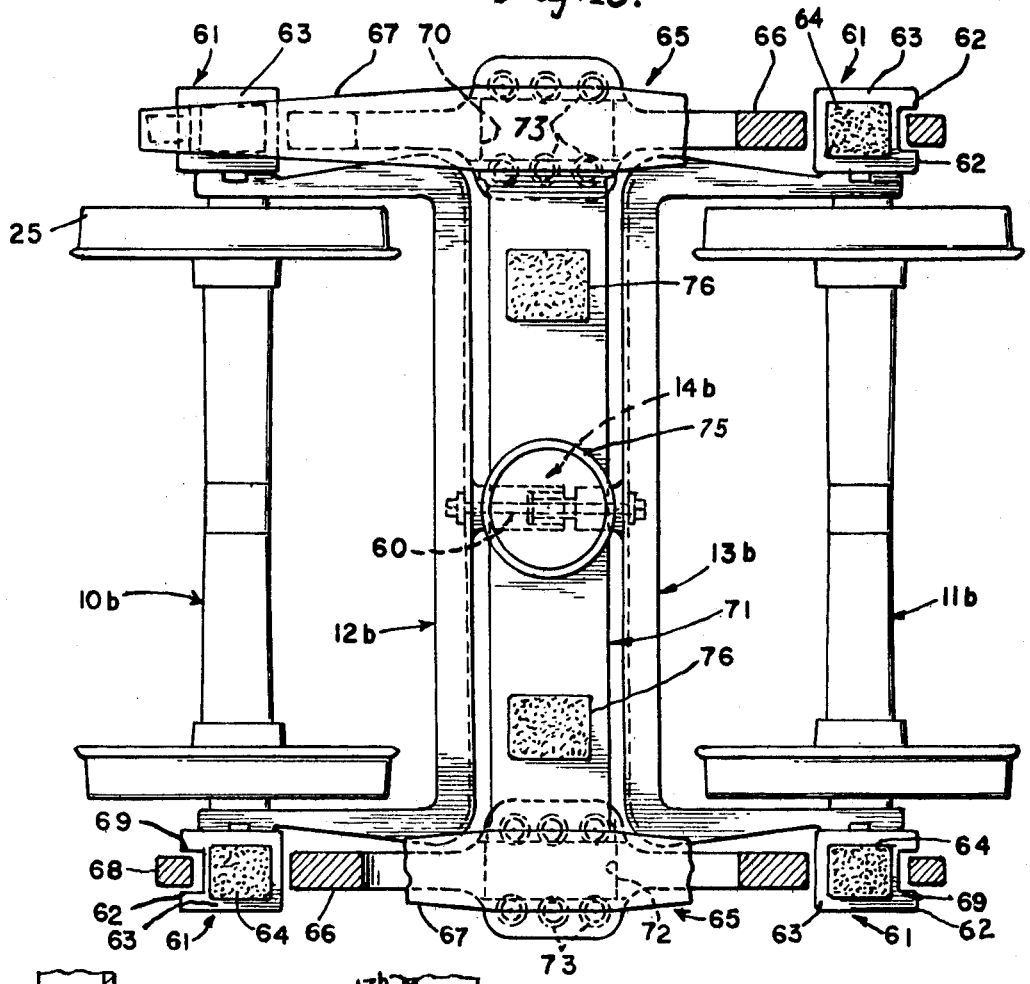
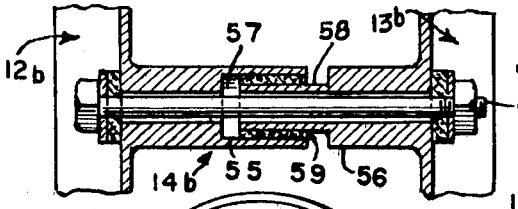
Fig. 15.
Fig. 14.
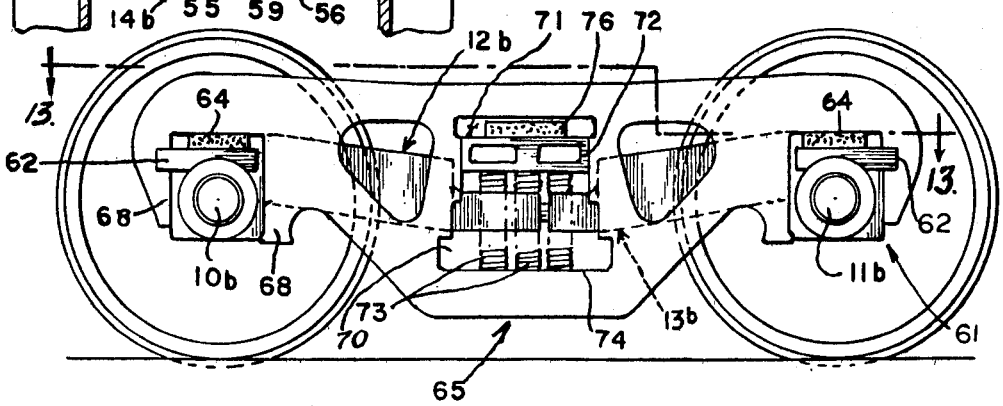

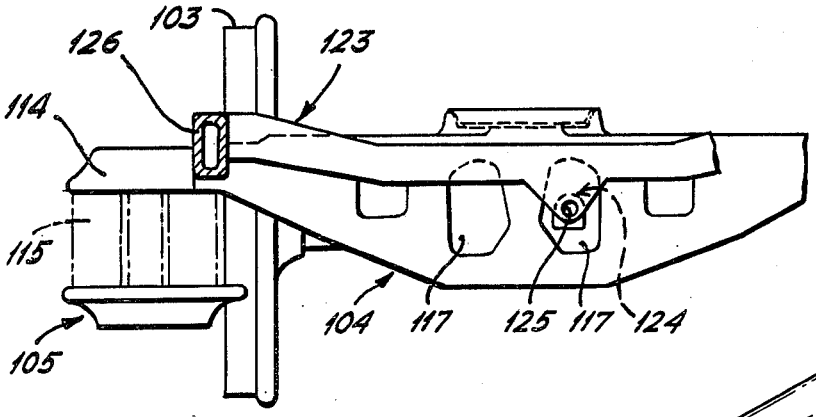
FIG. 18.
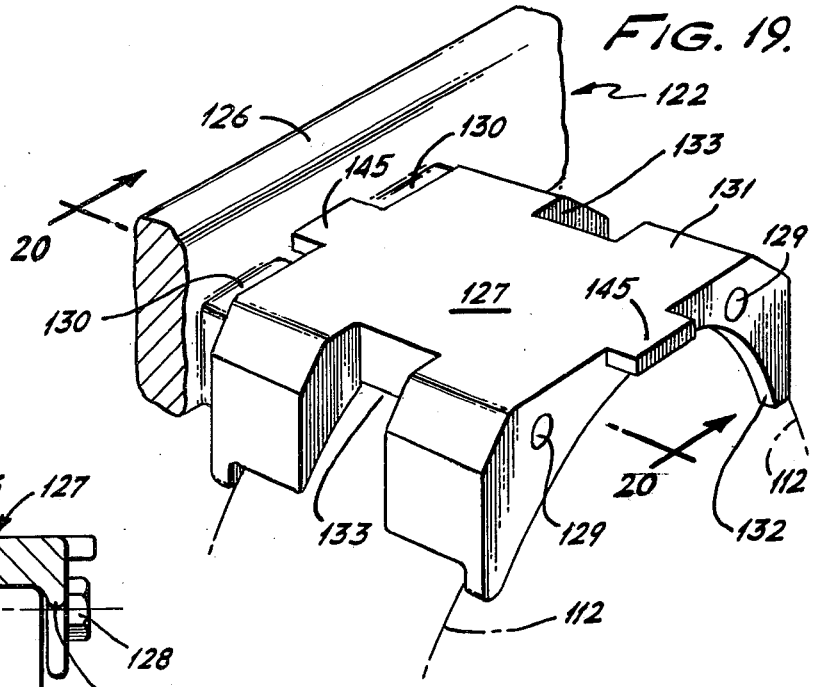
FIG. 19.
FIG. 20.
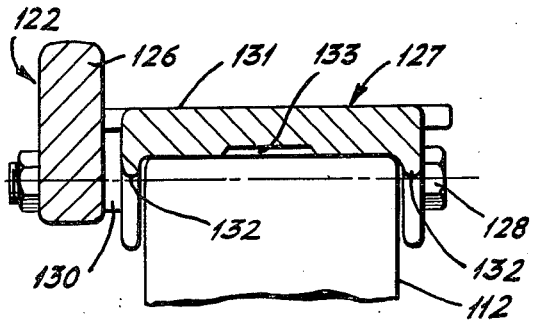
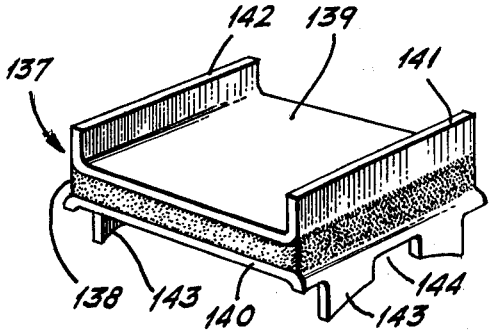
FIG. 22.
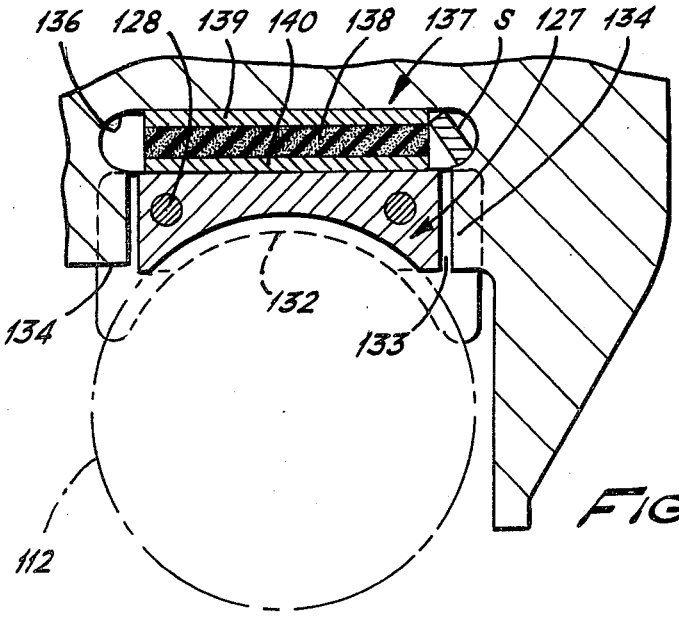
FIG. 21.

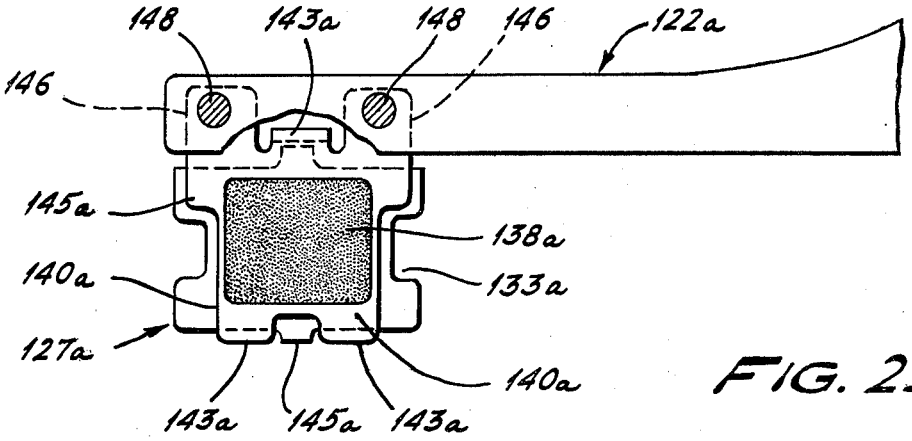
FIG. 23.
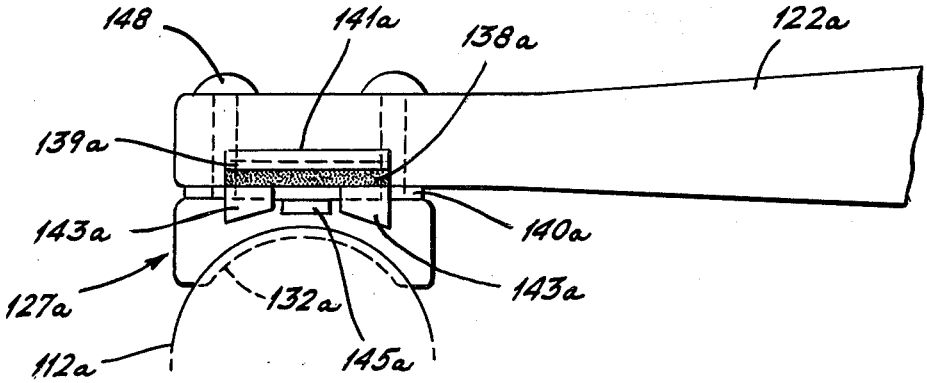
FIG. 24.
FIG. 25.
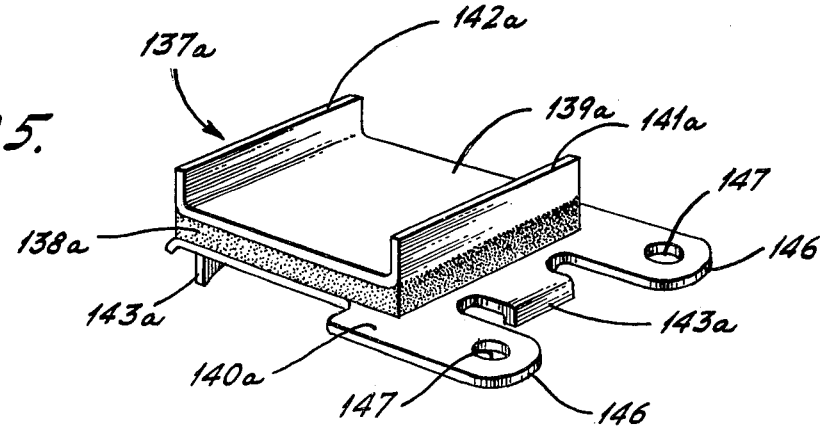

ARTICULATED TRUCKS

CROSS REFERENCES

This application is a continuation-in-part of my copending application Ser. No. 608,596, filed Aug. 28, 1975, and issued Dec. 26, 1978 as Pat. No. 4,131,069, and which is a continuation-in-part of my prior application Ser. No. 438,334, filed Jan. 31, 1974, now abandoned, which patent and applications are continuations or continuations-in-part of a group of prior applications, as completely identified in said application 608,596.

BACKGROUND AND SUMMARY OF THE INVENTION

The present application is primarily concerned with the adaptation of many features of the parent applications referred to above to existing trucks. By virtue of such adaptation or "retrofitting", it is not necessary, in order to utilize features of the invention, to completely replace existing railroad trucks.

The adaptation or "retrofit" arrangements to which the present application is directed thus have much background, objects and advantages in common with the arrangements of the parent application above referred to; and many of these features are set out herebelow, in addition to the retrofit technique and features, all of which are described and explained fully hereinafter.

While of broader applicability, for example in the field of highway vehicles where use of certain features of the invention can reduce lateral scrubbing of tires as well as lessening the width of the roadway required for negotiating curves, my invention is especially useful in railway vehicles and particularly railway trucks having a plurality of axles. Accordingly, and for exemplary purposes, the invention will be illustrated and described with specific reference to railway rolling stock.

The axles of the railway trucks now in normal use remain substantially parallel at all times (viewed in plan). A most important consequence of this is that the leading axle does not assume a position radial to a curved track, and the flanges of the wheels strike the curved rails at an angle, causing objectionable noise and excessive wear of both flanges and rails.

Much consideration has been given to the avoidance of this problem, notably the longstanding use of wheels the treads of which have a conical profile. This expedient has assisted the vehicle truck to negotiate very gradual curves.

However, as economic factors have led the railroads to accept higher wheel loads and operating speeds, the rate of wheel and rail wear becomes a major problem. A second serious limitation on performance and maintenance is the result of excessive, and even violent, oscillation of the trucks at high speed on straight track. In such "nosing", or "hunting", of the truck the wheelsets bounce back and forth between the rails. Above a critical speed hunting will be initiated by any track irregularity. Once started, the hunting action will often persist for miles with flange impact, excessive roughness, wear and noise, even if the speed be reduced substantially below the critical value.

In recent efforts to overcome the curving problem, yaw flexibility has been introduced into the design of some trucks, and arrangements have even been proposed which allow wheel axles of a truck to swing and thus to become positioned substantially radially of a curved track. However, such efforts have not met with any real success, primarily because of lack of recognition of the importance of providing the required lateral restraint, as well as yaw flexibility, between the two wheelsets of a truck, to prevent high speed hunting.

For the purposes of this invention, yaw stiffness can be defined as the restraint of angular motion of wheelsets in the steering direction, and more particularly to the restraint of conjoint yawing of a coupled pair of wheelsets in a truck. The "lateral" stiffness is defined as the restraint of the motion of a wheelset in the direction of its general axis of rotation, that is, across the line of general motion of the vehicle. In the apparatus of the invention, such lateral stiffness also acts as restraint on differential yawing, of a coupled pair of wheelsets.

The above-mentioned general problems produce many particular difficulties all of which contribute to excessive cost of operation. For example, there is deterioration of the rail, as well as widening of the gauge in curved track. In straight track the hunting, or nosing, of the trucks causes high dynamic loading of the track fasteners, and of the press fit of the wheels on the axles, with resultant loosening and risk of failure. A corresponding increased cost of maintenance of both trucks and cars also occurs. As to trucks, mention may be made, by way of example, to flange wear and high wear rates of the bolster and of the surfaces of the side framing and its bearing adapters.

As to cars, there occurs excessive center plate wear, as well as structural fatigue and heightened risk of derailment resulting from excessive flange forces. The effects on power requirements and operating costs, which result from wear problems of the kinds mentioned above, will be evident to one skilled in this art.

In brief, the lack of recognition of the part played by yaw and lateral stiffness has led to: (a) flange contact in nearly all curves; (b) high flange forces when flange contact occurs; and (c) excessive difficulty with lateral oscillation at high speed. The wear and cost problems which result from failure to provide proper values of yaw and lateral stiffness, and to control such values, will now be understood.

It is the general objective of my invention to overcome such problems by the use of self-steering wheelsets in combination with novel apparatus which maintains stability at speed, and to this end I utilize an articulated, self-steering, truck having novelly formed and positioned elastic restraint means which makes it possible to achieve flange-free operation in gradual curves, low flange forces in sharp curves, and good high speed stability.

I have further discovered that application of certain principles of this invention to highway vehicles not only reduces tire scrubbing and highway space requirements, as noted above, but also promotes good stability at high speed.

To achieve these general purposes, and with particular reference to railway trucks, the invention provides an articulated truck so constructed that: (a) each axle has its own, even individual, value of yaw stiffness with respect to the truck framing; (b) such lateral stiffness is provided as to ensure the exchanging of steering moments properly between the axles and also with the vehicle body; and (c) the proper value of yaw stiffness is provided between the truck and the vehicle.

An embodiment representative of the invention has been tested at nearly eighty miles per hour, with virtually no trace of instability. With another embodiment, radial curving has been observed at less than 50 foot radius, and flange-free operation is readily achieved with all embodiments on curves of at least 4 degrees.

With more particularity, it is an objective flexibly to restrain yawing motion of the axles by the provision of restraining means of predetermined value between the side frames and the steering arms of a truck having a pair of subtrucks coupled through steering arms rigidly supporting the axles. Elastomeric means for this purpose are provided between the axles and the adjacent side frames, preferably in the region of the bearing means. Such means may be provided at one or both axles of the truck. If provided at both axles, it may have either more or less restraint at one axle, as compared with the restraint at the other, depending upon the requirements of the particular truck design.

It is a further object of this invention to provide elastomeric restraining means in the region of the coupling between the arms to damp lateral axle motions, which results in so-called "differential" yawing of a coupled pair of subtrucks.

The invention is also featured by certain tow bar improvements which take care of longitudinal forces between the car body and the flexibly mounted wheelsets. This arrangement has several advantages, discussed hereinafter, one of which is to prevent excessive deflections, in the elastomeric pads which mount the steering arms to the side frames and the side frames to the car body.

In accordance with another feature of the invention, a special sliding bearing surface is provided between the truck side frames and the car body, further to limit the flange forces in very sharp curves.

My invention also contemplates brake improvements which, when used in conjunction with articulated trucks characteristic of this invention, virtually eliminate contact of the brake shoes with the wheel flanges. Prior to the invention such contact has resulted in substantial wear and in uneven braking.

An important feature of the present invention is the provision of a novel technique for retrofitting existing trucks to provide for the steering of the wheelsets. Thus, an important characteristic of this invention is the fact that it may readily be applied to existing trucks, for example to the 100 ton roller bearing, freight truck design of the Association of American Railroads. Accordingly, one embodiment of the invention, herein disclosed and claimed, teaches the retrofitting of the AAR truck with self-steering wheelsets combined with the stabilizing elastomeric coupling and restraining means characteristic of my invention.

BRIEF DESCRIPTION OF THE DRAWINGS

In the drawings, the invention is shown schematically in FIGS. 1–4. In addition, four structural embodiments representative of my invention are illustrated. A first appears in FIGS. 5–12; a second in FIGS. 13–15; a third in FIGS. 16–22; and a fourth in FIGS. 23–25. Each of these four embodiments utilizes principles and features taught in more general terms in FIGS. 1–4, and the third and fourth embodiments concern the retrofitted arrangement mentioned above. The drawings also include three figures (26–28) showing the AAR truck. These figures are labelled "prior art" and will assist in understanding the simple yet effective way in which the invention may be applied to such a truck, while utilizing most of the truck parts with a minimum of modification. With further general reference to the drawings:

FIG. 9 is a cross-sectional view taken on the line 9—9 of FIG. 6;

FIG. 10 is an enlarged cross-sectional view of the journal box structure taken on the line 10—10 of FIG. 6;

FIG. 11 is an enlarged sectional view of the central connection of the steering arms taken on the line 11—11 of FIG. 7;

FIG. 12 is a cross section taken on the line 12—12 of FIG. 11;

FIG. 13 is a plan view illustrating the second structural embodiment of a railway truck, and uses side frame and bolster castings somewhat similar to those used in conventional freight car trucks;

FIG. 14 is a side elevational view of the apparatus of FIG. 13;

FIG. 15 is an enlarged sectional plan view of the central connection device of the steering arms of the truck of FIGS. 13 and 14;

FIGS. 16, 17 and 18 are, respectively, plan, side and sectional views of the mentioned third structural embodiment of the invention;

FIGS. 19–22 are views showing details of the apparatus appearing in FIGS. 16–18, on a larger scale, two of these detail views being in perspective;

FIGS. 23 and 24 are, respectively, partial plan and side views of the apparatus of the fourth embodiment, and FIG. 25 is a perspective showing of a part of that apparatus.

DETAILED DESCRIPTION

Figure 1:
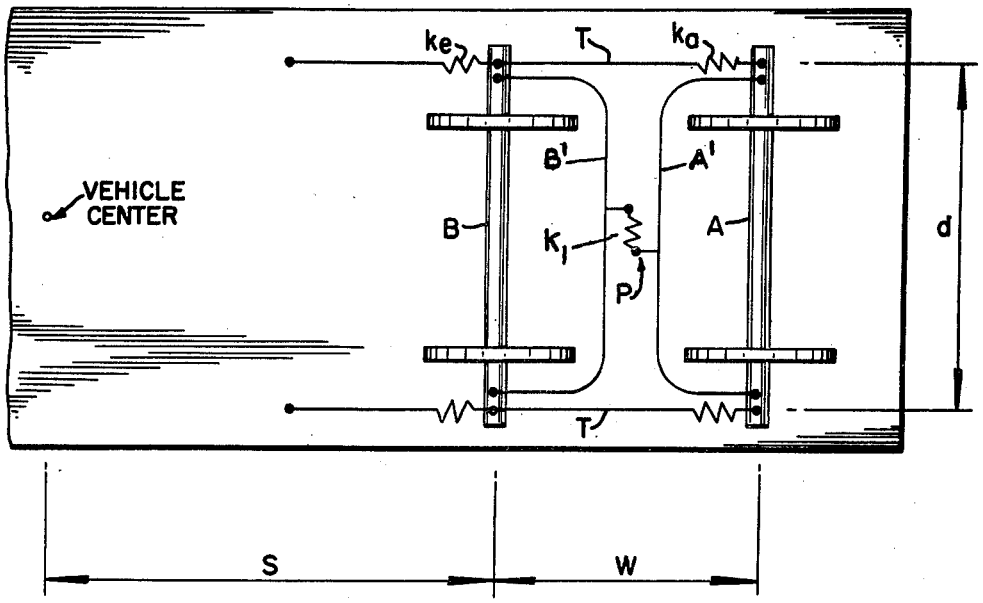
FIG. 1 is a schematic showing of the invention, and illustrating a railway vehicle having truck means which include a pair of wheelsets coupled and damped in accordance with principles of the invention.
Figure 2:
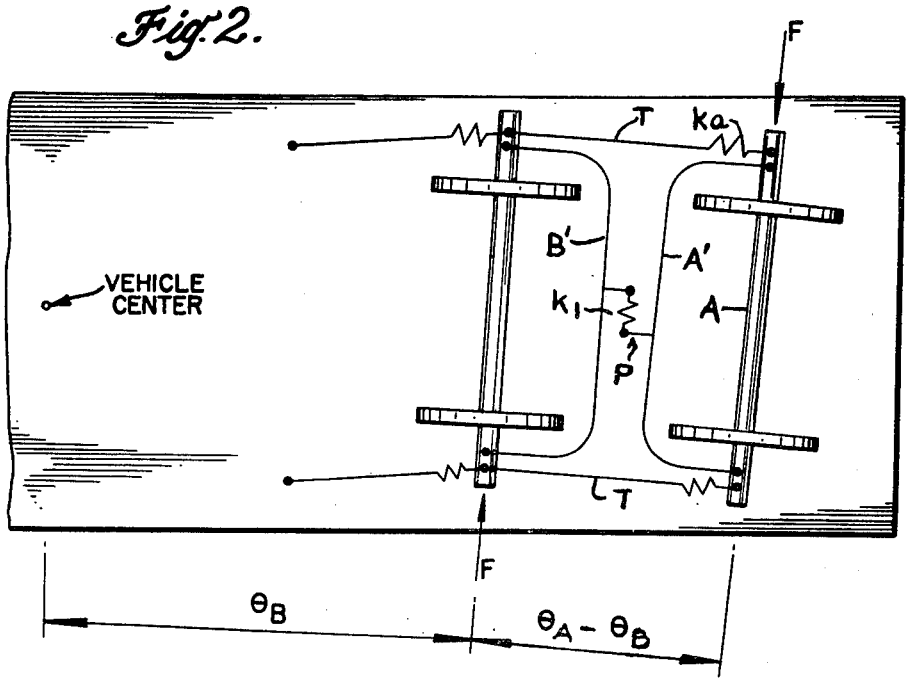
FIG. 2 shows schematically, and in basic terms, the response of such a truck to a curve.

The steering action of a four-wheel railroad car truck constructed according to the invention is illustrated somewhat schematically in FIGS. 1 and 2. The embodiment for use under the trailing end of a highway vehicle would be virtually identical, but, for simplicity, railroad truck terminology is used in the description.

The essential parameters are as follows:

The yaw (longitudinal) stiffness between the "inside" axle "B" and the truck side frames "T" is very high, i.e. a pinned connection.

The yaw stiffness between the "end" axle "A" and the truck side frames "T" is $k_a$.

The yaw stiffness between the truck side frames "T" and the vehicle is $k_e$.

The side frames "T" are essentially independent being free to align themselves over the bearings (not illustrated) of axles "A" and "B", even when there is substantial deflection in the longitudinal direction of the resilient member $k_a$.

Lateral forces between the two axles are exchanged at point "P", located in the mid-region between a pair of subtrucks, or steering arms, A' and B'. This interconnection has a lateral stiffness of $k_1$ and may also make a contribution to the yaw stiffness between the two axles. This connection provides for balancing of steering moments between the two axles, as well as providing the lateral stiffness.

The basic response of such a truck to a curve is shown in FIG. 2. The elastic restraints $k_a$ and $k_e$ have been deflected by lateral forces "F". The forces "F" can arise either from flange contact or from steering moments caused by creep forces between the wheels and the rails. Experimentally it has been observed that for relatively low values of $k_a$ and $k_e$, the axles will tend to assume a radial position in curves for a large range of variation of the ratio $k_a/k_e$. I have further discovered that for higher values, the proper value for this ratio must be chosen as a function of the truck wheelbase "w" and the distance s from axle "B" to the vehicle center. Thus a means is provided to have the high value for yaw stiffness needed for high speed stability while simultaneously providing radial positioning of the axles in sharp curves. The basic mathematical relationships which assure radial positioning of the axles are as follows:

For the axles to be in a radial position, their angular displacement will be proportioned to their distance from the center of the car body;

$\theta_A-\theta_B=c\times w$ and $\theta_b=c\times s$, where c=the curvature per foot of length along the curve. This gives the following ratio between the angles and the distances.

$$\theta_A-\theta_B/\theta_B=w/s$$

The angles are also dependent on the yaw stiffness.

$$\theta_A-\theta_B=F\times w/2/k_a\times d \text{ and } \theta_B=F\times w/k_e\times d$$

Substituting, we find that the relationship between the yaw stiffnesses and the distance should be:

$$k_e=k_a\times 2w/s, \text{ or } k_a/k_e=s/2w.$$

Given the proportionality $k_a/k_e=s/2w$ it is a simple matter to translate the values for elastic restraint into suitable components. In the design and testing of one of the truck embodiments described below, the value for $k_a$ was selected to obtain stability against hunting up to a car speed of one hundred miles per hour. With this component established, use of the proportionality considered above readily yields the values to be embodied in the other elastomeric restraints, which are disposed between the car body and side frame ($k_e$).

In the case of rail vehicles where there is only a small clearance between the wheel flanges and the rail, the above ratio should be closely maintained. The action of the forces arising from the self steering moments of the wheelsets will correct for some error, and the curving behavior will be superior to a conventional truck, even if it is not perfect.

In the case of highway vehicles, when a low value of $k_a$ is chosen, the rear bogie will tend to follow the front end of the vehicle rather precisely in a curve. As $k_a$ is increased, the trailing end of the vehicle will track inside the front end. If $k_a$ is made very stiff, the bogie will approach, but always be superior to, the tracking characteristics of a conventional bogie. As will be understood, given $k_a$, $k_e$ can be calculated.

Figure 3:
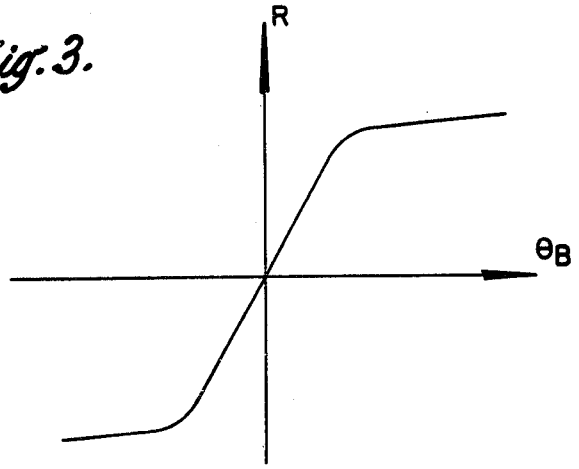
FIG. 3 shows a plot of the reaction of the flange force between the truck side frames and the vehicle, using modified restraining means and under conditions of very sharp curving, the reaction being plotted against the angle of track curvature.

While the apparatus shown schematically in FIGS. 1 and 2 will provide the desired major improvement in curving behavior and high speed stability on all ordinary railroad curves, there is also a need to limit the flange force "F" which occurs when operating occasionally on very sharp curves. This is most easily done by making $k_e$ a non-linear elastic restraint as shown in FIG. 3.

This restraint is comprised of a steep linear center section where $k_e=k_a\times 2w/s$ and end sections where the value is much less. This will limit the reaction force "R" between the truck side frames and the vehicle, which will in turn limit the flange force "F".

Figure 4:
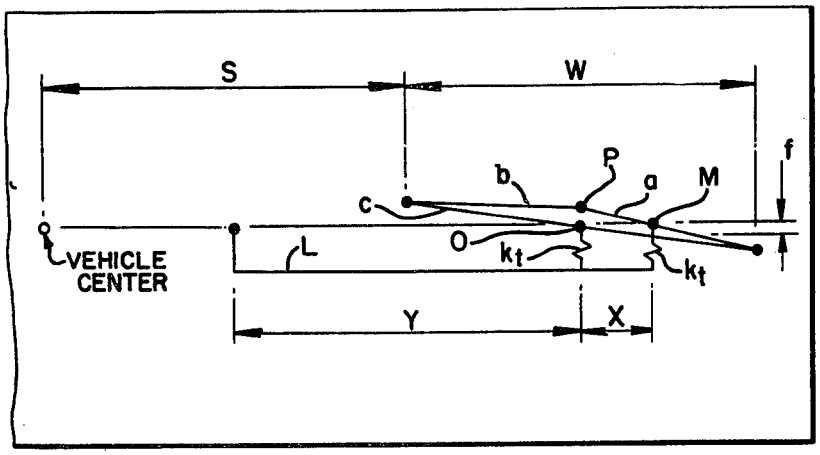
FIG. 4 is a force diagram analyzing the response of a truck generally similar to that shown in FIG. 1, and including in addition a steering link or tow bar.

For certain applications such as rail rapid transit vehicles where there is a need to obtain the lowest possible flange wear and operating noise on sharp curves, and at the same time obtain good high speed stability, it will be found desirable to add the feature shown in FIG. 4. The addition of steering link, or tow bar, "L" provides a means to keep the yaw stiffness high on straight track without contributing significantly to the flange force in curves. The presence of the restraints $k_t$ make it possible to choose low values for $k_a$ and $k_e$ without sacrificing yaw stiffness between the vehicle and the running-gear and within the running-gear.

The following parameters are dealt with in consideration of FIG. 4:

s=distance from vehicle center to closest axle;
w=truck wheelbase, axle-to-axle;
b=center line of subtruck (steering arm) associated with axle B;
a=center line of subtruck (steering arm) associated with axle A;
c=center line of truck framing;
O=center (pivot point) of truck framing;
P=point of interconnection of the subtrucks;
L=tow bar (steering link). In FIG. 4 it is shown offset from the vehicle centerline better to show $k_t$;
M=the point of interconnection between the tow bar and subtruck a;
x=the distance between the truck center O and the inter-connection at M;
$k_t$=the lateral flexibility which limits the ability of the steering link to keep the lateral position of M the same as the lateral position of P; [When certain prototype trucks were operated in the FIG. 4 configuration, $k_t$ was the lateral stiffness of pads used to provide $k_a$ between the side frames and the subtrucks].
y=the distance between the connection of the steering link to the truck framing at M, and the point of connection of the link to the vehicle; and
f=the distance between the truck centerline and point M at the distance x from the truck center.

This dimension is used in deriving the computation of the proper dimension for x.

The optimum values for x and $k_t$ must be found by experiment. However, it can be shown that x should be larger than a specific minimum at which the axles would assume a radial position if the restraints $k_t$ were infinitely rigid. This minimum value can be calculated using the equation $x_{min}=w^2/4(s+w)$. This value is based on the fact that the angle between "b" (L to axle B, FIGS. 1 and 2) and the vehicle centerline, and the angle between "a" (L to axle A, FIGS. 1 and 2) and the vehicle centerline are proportional to the distances from the center of the vehicle (w and s+w). The lateral distance "f" in FIG. 4 can be calculated two ways, i.e.:

(1) $f=1/i\ r(2s+w)x$ and;

(2) $f=1/r(w/2-x)w$ where $1/r$ is the track curvature.

Equating these two expressions;

$$2sx+wx=(w/2-x)w$$

Solving for x gives; $x=w^2/4(s+w)$.

The optimum value for $k_t$ will depend primarily on the total value for yaw stiffness required for high speed stability, the percentage of that value supplied by $k_a$ and $k_e$, and the percentage of that value contributed by the rotational stiffness of the connection at P. The value $k_t$ can be chosen to make up the remainder required.

There is also the question of choosing a proper value for y. This should in general be chosen as long as practical, if it is desired to minimize coupling between the lateral motion of the vehicle with respect to the running-gear and the steering motions of the axles. However, the length y has been made as short as two thirds w with success in prototypes, there being some indication in testing that a certain amount of coupling between lateral motion of the car body, with respect to the truck, and the steering action of the truck helps to stabilize lateral motions of the car body.

The principles disclosed above can be used directly to design running-gear having an even number of axles by grouping them in pairs. These principles have also been used to design a three-axle bogie, not shown.

Figure 26:
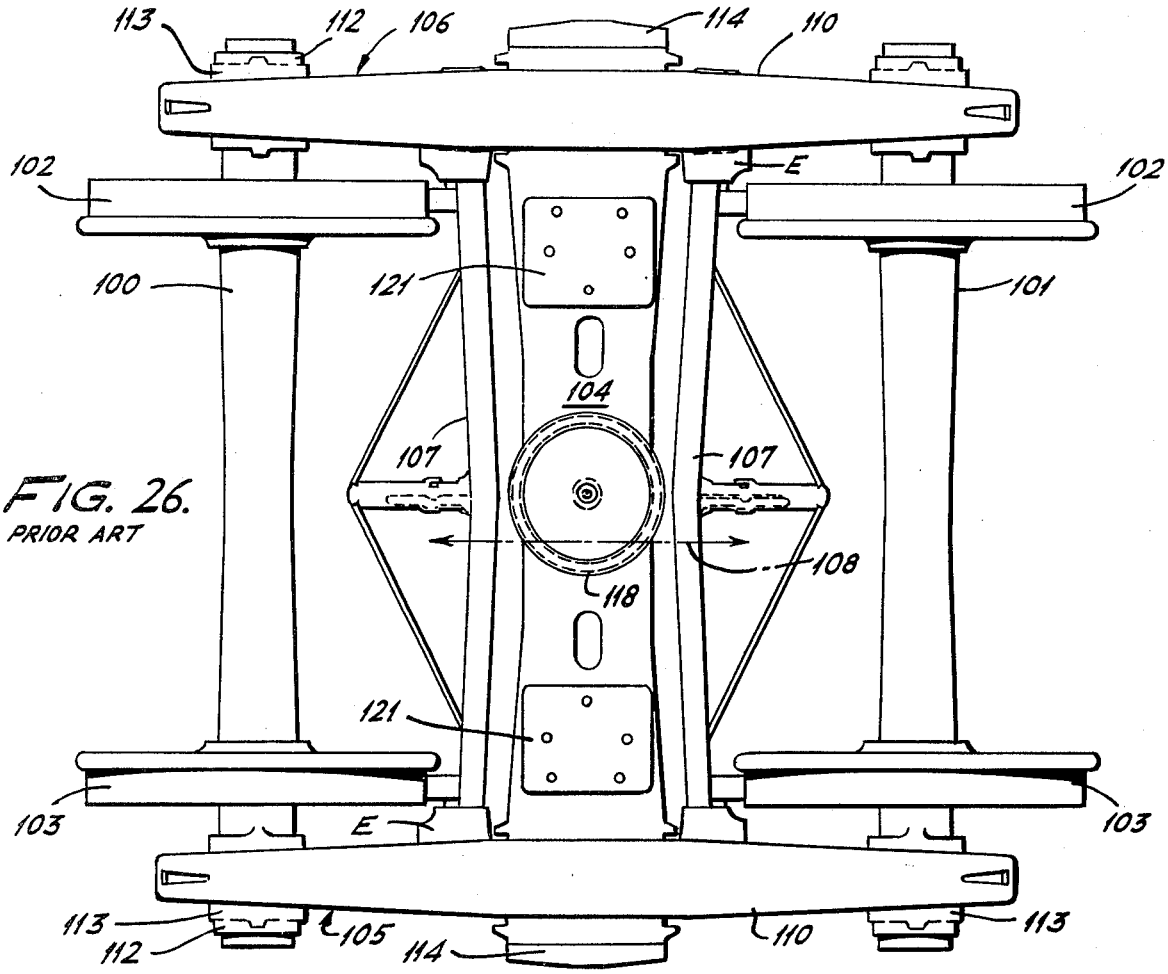
FIG. 26. PRIOR ART
FIGS. 26, 27 and 28 show the prior art truck prior to the retrofitting as shown for example in FIGS. 16 to 22.
Figure 27:
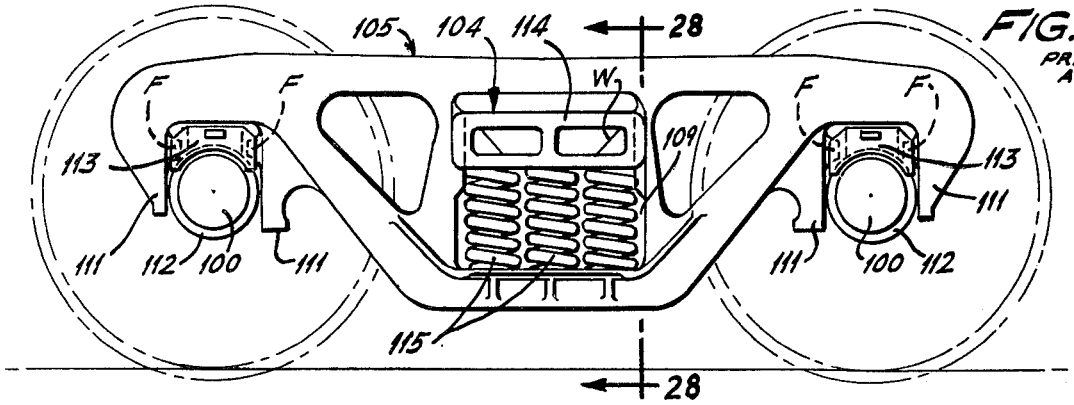
FIG. 27. PRIOR ART
Figure 28:
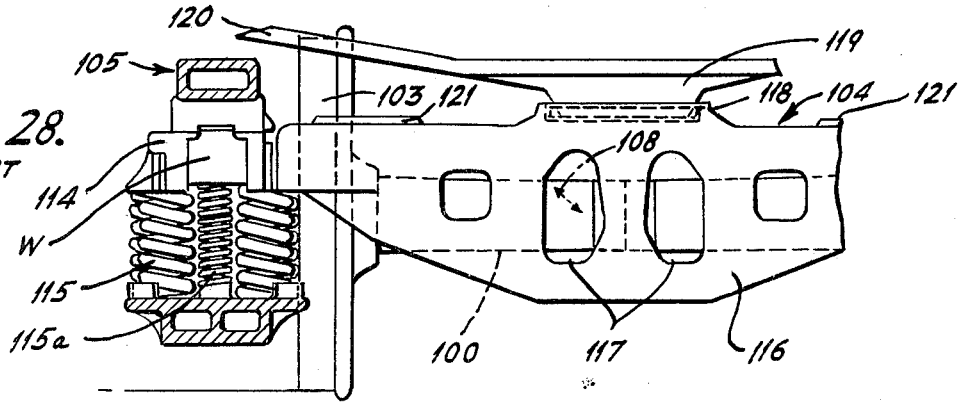
FIG. 28. PRIOR ART

The principles considered above have been applied in the design of a number of specific trucks, particularly railway freight trucks. As will now be understood, four such embodiments are shown. One appears in FIGS. 5 to 12, another in FIGS. 13 to 15, the third in FIGS. 16 to 22, and the fourth in FIGS. 23 to 25. The latter two embodiments are "retrofit" arrangements and will be considered in comparison with the prior art, as illustrated in FIGS. 26 to 28.

With detailed reference, initially, to FIGS. 7 and 8, from which parts have been omitted more clearly to show the manner in which each of two axles 10 and 11 is rigidly supported by its subframe (termed a "steering arm" in the following description), it will be seen that each axle is carried by its steering arm, 12 and 13, respectively, and that each axle has a substantially fixed angularity with respect to its steering arm, in the general plane of the pair of axles. The steering arms are generally C-shaped, as viewed in plan, (c.f. the steering arms A' and B' of FIGS. 1 and 2), and each has a portion extending from its associated axle to a common region (12*a*, 13*a*) substantially midway between the two axles. Means bearing the general designation 14, to which more detailed reference is made below, couples the steering arms 12 and 13 with freedom for relative pivotal movement and with predetermined stiffness against lateral motion in the general direction of axle extension. In this embodiment the stiffness against lateral motion, in the direction of axle extension and in the plane of the axles (it corresponds to the resilient means $K_1$ shown diagrammatically at P in FIG. 1), takes the form of a tubular block 15 of any suitable elastomeric material, e. g. rubber. It is suitably bonded to a ferrule, or bushing 16 (see particularly FIGS. 11 and 12), which is provided as an extension of steering arm 13, and to a bolt 17 which couples the steering arms, as is evident. This block or pad 15, through which the steering moments are exchanged, has considerable lateral stiffness. The resilience is sufficient so that each axle is free to assume a position radial of a curved track, and sufficient to allow a slight parallel yaw motion of the axles. This acts to prevent flange contact on straight track when there are lateral loads such as strong cross winds.

Figure 7:
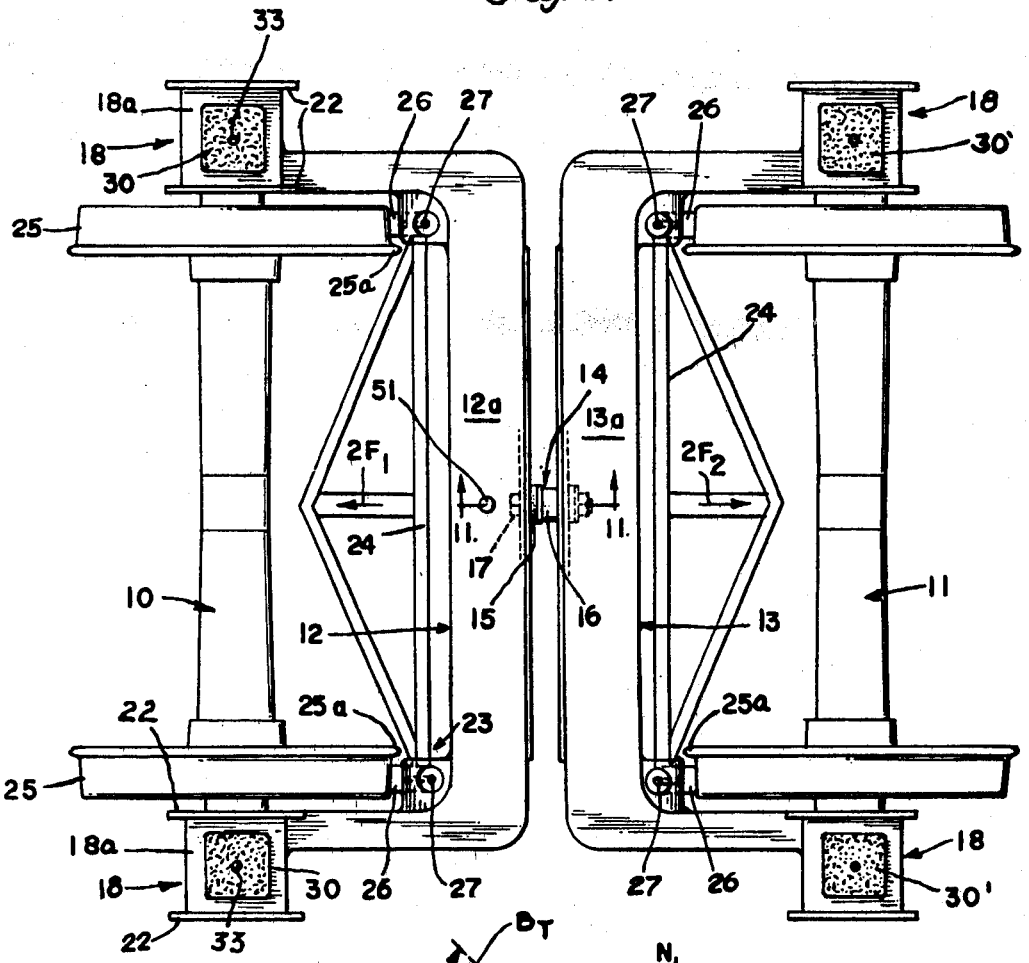
FIG. 7 is a plan view of the railway truck of FIGS. 5 and 6 with certain upper parts omitted, in order more clearly to show the steering arms, their central connection, and features of brake rigging.
Figure 8A:
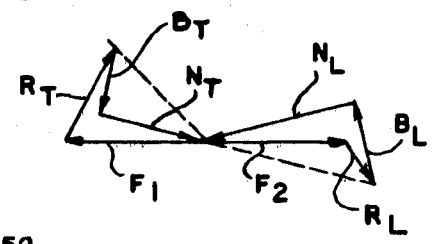
FIG. 8*a* is a force polygon illustrating the functioning of the brakes.
Figure 8:
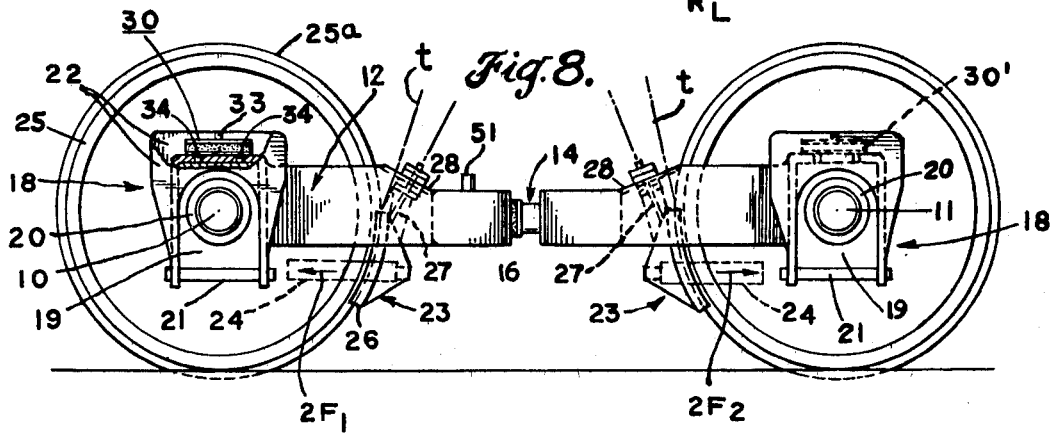
FIG. 8 is a side elevational view of the apparatus shown in FIG. 7.

Turning now to the manner in which each axle is carried by its associated arm, it is seen that each steering arm carries, at each of its free ends, journal box structure 18 integral with the arm (see for example arm 12 in FIGS. 7 and 8). The box shape can readily be seen from the figures and opens downwardly to receive bearing adapter structure 19, of known type, which locates the bearing cartridge 20. Both ends of both axles 10 and 11 are mounted in this fashion, which does not require more detailed description herein. Retaining bolts 21 prevent the bearing 20 from falling out of the adapter 19 when the car truck is lifted by the truck framing.

Each journal box 18 has spaced flanges 22,22 which have portions extending upwardly and laterally of the journal box. These flanges define a pedestal opening which serves as retaining means for the car side frames, and also for novel pads interposed between the journal boxes and the side frames, as will presently be described. However, before proceeding with that description, and still with reference to FIGS. 7 and 8, it will be noted that each steering arm 12 and 13 carries a novel brake and brake beam assembly. These assemblies are designated, generally, at 23 (FIG. 8) and each includes a braced brake beam 24, extending transversely between the wheels (e.g. the wheels 25,25 carried by axle 10), and each end of each beam carries a brake shoe 26 which is aligned with and disposed for contact with the confronting tread of the wheel. The mounting of the brake assemblies is characteristic of this invention—in which each axle is fixed as against swinging movements with respect to its associated steering arm—and has significant advantages considered later in this description. For present purposes it is sufficient to point out that the brake beams 24 are prevented from moving laterally toward and away from the flanges 25*a* of the wheels, and for this purpose the opposite end portions of the beams are carried by rod-like hangers 27, each of which extends through and is secured in a sloped pad 28 provided in corner portions of each steering arm 12 and 13 (see particularly FIG. 8).

Figure 5:
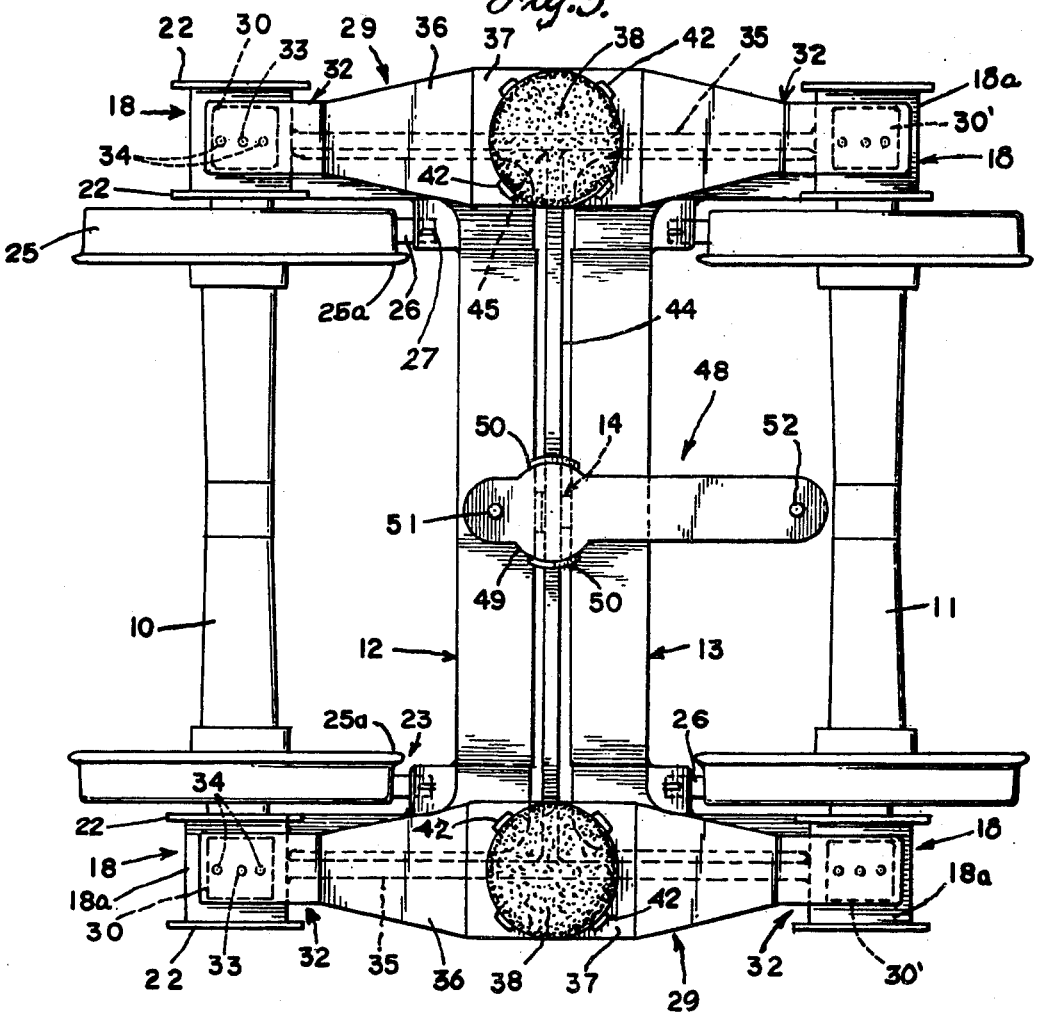
FIG. 5 is a plan view of the first structural embodiment referred to above and shows a railway truck constructed in accordance with the invention, and embodying principles illustrated schematically in FIGS. 1 and 4.
Figure 6:
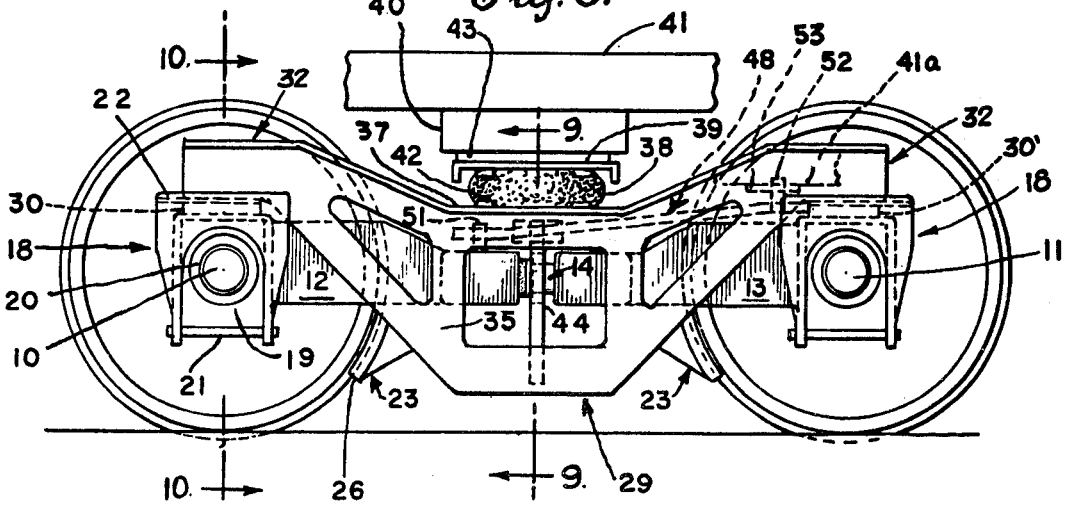
FIG. 6 is a side elevational view of the apparatus shown in FIG. 5.

In particular accordance with my invention, and with reference to FIGS. 5 and 6, reference is now made to the manner in which the truck side frames 29,29 are carried by the steering arms, being supported upon elastomeric means which flexibly restrains conjoint yawing motions of the coupled pair of wheelsets, that is provides restraint of the steering motions of the axles with respect to each other, and thus opposes departure of the subtrucks (the steering arms and their axles) from a position in which the wheelsets are parallel. As will now be understood from FIGS. 2 and 3, described above, this restraining means ($k_a$ in those figures) may be provided only at the ends of that axle which is more remote from the center of the vehicle. However, it is frequently desirable to provide such restraint at the ends of each axle. Accordingly, FIGS. 5 and 8 show restraint at each axle; it can be of different value at each, depending upon the particular truck design.

As shown in FIGS. 5 to 8, the restraining means takes the form of elastomeric pads 30, preferably of rubber, supported upon the journal box, between the flanges 22, and interposed between the upwardly presented, flat, surface 18*a* of each journal box 18 and the confronting lower surface 31 (FIG. 10) of the I-beam structure which comprises the outboard end portions 32 of each side frame 29. As indicated in FIGS. 7 and 8, and as shown to best advantage in FIG. 10, the pads 30 are sandwiched between thin steel plates 30*a*,30*a*, the upper of which carries a dowel 33 and the lower of which is provided with a pair of dowels 34. The upper and lower dowels are received within suitable apertures provided, respectively, within the surface 31 of side frame end portion 32, and the confronting surface 18*a* of journal box 18. The purpose of the dowels is to locate the elastomeric pads 30 with respect to the journal box, and to position the side frame with respect to the pad 30. The side frame is thus supported upon the pads and between the flanges 22.

As shown in FIG. 6, each side frame 29 has a center portion which is lower (when viewed in side elevation) than its end portions 32. This center portion includes part of a web 35 having a top, laterally extending, flange 36 which is narrower at its outer extremities (FIG. 5) which overlie the journal box 18, and provides the bearing surface 31 (FIG. 10). The flange 36 reaches its maximum width in a flat central section 37 which comprises a seat for supporting an elastomeric spring member 38. This member has the form, prior to imposition of the load, of a rubber sphere. Member 38, although not so shown in the drawings, may if desired be sandwiched between steel wear plates. Desirably, and as shown, means is provided for locating the member 38 with respect to the seat 37 of the side frame, and with respect to the overlying car bolster 39 (FIGS. 6 and 9), which, with sill 40, spans the width of the car and is secured thereto. The car is illustrated fragmentarily at 41, in FIG. 6. This locating means, as shown in FIGS. 5, 6 and 9, may conveniently take the form of lugs 42 integral with the support surface 37 and the confronting lower surface of car bolster 39. A bearing pad 43, which may be of Teflon, or the like, is interposed between the upper surface of car bolster 39 and the overlying car sill structure 40 (FIGS. 6 and 9). This forms a sliding bearing surface, which operates to place a limit on flange forces which might otherwise become excessive in very sharp curves.

As will now be understood, the resilience of the elastomeric sphere-like members 38 provides the restraint identified as $k_e$ in the description with reference to FIGS. 1 and 2. As stated, its value is determined in accordance with the proportionality $k_a/k_e=s/2w$. In one embodiment of the invention, which yielded good results, sphere-like springs marketed by Lord Corporation, of Erie, Pennsylvania, and identified by part number J- 13597-1, were found suitable for applicant's special purposes described above.

The truck shown in FIGS. 5–8 can be made to function as does the truck of FIGS. 1 and 2 by either omitting pads 30′ at axle 11, or by making these pads substantially stiffer than pads 30 at axle 10. The benefit achieved by doing this is that the steering effect of a linkage L, such as shown in FIG. 4, is obtained merely by the proper distribution of the stiffness of pads at the axles.

A support, or cross-tie, 44 extends between the webs 35 of the side frames 29, in the central portion of the latter (FIGS. 5 and 6), and has its ends fastened to the side frame web as shown at 45 in FIG. 9. The cross-tie is a relatively thin plate with its height extending vertically, and its center portion has an aperture 46 through which passes the means 14 which couples the mid-portions of the two steering arms 12 and 13. The aperture 46 is of larger diameter than the coupling means 14. As shown in FIG. 9, and as also appears in FIG. 6, it is important for the purposes of the invention that there be freedom for limited tilting of one side frame with respect to the other, in the general plane containing the axles 10 and 11. (See also the flexible side frames T of the apparatus shown schematically in FIGS. 2 and 3.) In the present embodiment this freedom is ensured by limiting the thickness of the cross-tie 44 to a value such as to permit the required flexibility between side frames, and by the freedom for relative movement between means 14 and cross-tie 44, afforded by the clearance of the cross-tie in the aperture.

A pair of strut-like dampers 47,47 interconnect the side frames and the car bolster 39. While these dampers have been omitted from FIGS. 5 and 6, in the interest of clarity of illustration, they show to good advantage in FIG. 9. Their purpose is to damp vertical and horizontal excursion of the car body and, importantly, they are inclined inwardly and upwardly to minimize the effect of vertical track surface irregularities on lateral motion of the car body.

In certain embodiments of the present invention it has been found very advantageous to have a tow bar which interconnects one steering arm with the body of the car or other vehicle. The tow bar comprises the steering link L, in the diagrammatic representations of FIG. 4, and it appears at 48 in FIGS. 5, 6 and 9. Its disposition and point of securement to the car body are unique to this invention as has already been explained with reference to FIG. 4.

As best shown in FIGS. 5 and 9, the tow bar 48 has an arcuately formed portion 49 intermediate its ends and this portion 49 is journaled within and cooperates with spaced, confronting arcuate flanges 50,50, carried by the central part of the upper edges of the tie-bar 44. This cooperation provides for swinging movements of the tow bar about the center of its said arcuately formed portion 49 and permits the side frame assembly to serve as a point of reaction for torque forces imposed by the connection of the ends of the tow bar to one of the steering arms and to the car body. As illustrated in FIGS. 5 and 6, the left end of the tow bar overlies the steering arm 12, which should be understood as being associated with that axle (10) which is the more remote from the center of the car body. This end is connected to steering arm 12 by pivot mechanism represented by the pin 51. The opposite end of the tow bar extends in the direction of the center of the car body, and its pin 52 is rotatably carried by a tow bar trunnion 53 secured to a portion 41*a* (FIG. 6) of the car sill structure 40, at a point lying along the longitudinal centerline of the car (FIG. 5).

In accordance with this invention, and as described above with reference to FIG. 5, the point of securement of the tow bar 48 to the more remote steering arm 12 is at a point 51 whose location is a function of the truck assembly's wheelbase w, and the distance s between the two truck assemblies, under a car body. The minimum value of the distance x, from the truck center 49 to the point 51, should satisfy the expression $x_{min}=w^2/4(s+w)$. The primary function of the tow bar is to take care of longitudinal forces between the car body and the resiliently mounted wheelsets. Such forces arise, for example, from braking and coupling impacts. In conventional trucks, e.g. freight car trucks now in common use, where no tow bar is present, these forces associated with braking and coupling are passed through the bolster and side frames. In the apparatus of the present invention, these forces, particularly the forces caused by coupling impacts, would, if not properly dissipated, cause unacceptable deflections and wear in the elastomeric pads 30 which mount the steering arms to the side frames, and the side frames to the car body.

Reference is now had to a modified form of railway truck embodying the invention, and illustrated in FIGS. 13 and 15. In this somewhat simpler apparatus a cross bolster is embodied in the truck, and imposes the weight of the car upon the side frames. Additionally this truck bolster is flexibly associated with the two side frames and serves as the only interconnection between the two.

In terms of basic structure for supporting the axle-borne wheelsets, and for providing resilient damping at the axle end portions, and also between the truck and the car body, the apparatus is in many respects similar to the embodiments already described. Accordingly, like parts bear like designations, with the subscript b. Thus, axles 10*b* and 11*b* are, respectively, carried by generally C-shaped steering arms 12*b* and 13*b*, and each steering arm, as was the case in the preceding embodiment, has a portion extending from its associated axle, with respect to which it has a substantially fixed angularity, to a common region substantially midway between the two axles. Means 14*b* couples the steering arms with freedom for relative pivotal movement, and with predetermined substantial stiffness against lateral motion in the general direction of axle extension. In this embodiment, the coupling means 14*b* (see FIG. 15) comprises a pair of studs 55 and 56, each of which extends from an associated one of the steering arms toward the zone of coupling. The stud 55, carried by arm 12*b*, is recessed as shown at 57, while stud 56 has a reduced, hollow end portion 58 which extends within the recess. Elastomeric material 59, preferably rubber, is interposed between extension 58 and the interior wall defining the recess 57, and is bonded to the adjoining surfaces. A bolt 60 serves to retain the parts in assembly. Again, as was the case with the preceding embodiment, the coupling 14*b*, through which the steering moments are exchanged, has considerable lateral stiffness and an angular flexibility sufficient so that each axle is free to assume a position radial of a curved track and free to adjust to track surface irregularities.

As shown in the cross-sectional portions of FIG. 13, which is taken as indicated by the line 13—13 applied to FIG. 14, it will be seen that each steering arm has journal box structure 61, at each end thereof, and in this case flanging, shown at 62, projects from the journal box structure in the direction of the length of the truck. The journal box has an upper substantially flat surface 63 upon which is seated an elastomeric pad 64. These pads may be sandwiched in steel and, if desired, mounted upon the surface 63 in the manner already described with respect to FIGS. 5–8. The axles 10*b* and 11*b* are supported by structure which is of the character already described with respect to the earlier embodiment, and which fits within the downwardly facing pedestal opening provided by jaws 68. In practice, means (not shown) would be provided to retain the axle and the bearing adapter structure within the pedestal opening. Brakes have also not been illustrated, since in this embodiment, they would either be conventional or be of the kind already described with respect to FIGS. 5, 6 and 9.

In accordance with my invention, the truck side frames 65,65 are carried upon the bearing portions of the steering arms and, importantly, are supported upon the pads 64, as appears to good advantage in FIG. 14. Such pads have been shown at each end of each axle, although it will now be understood that they may be used at the ends of one axle only, or that pads providing different degrees of flexible restraint may be used with each axle. These pads, as will now be understood, restrain the steering motions of the axles with respect to each other and oppose departure of the subtrucks, which are comprised of the wheelsets and steering arms, from a position in which the wheelsets are parallel. Each side frame comprises a vertically extending web portion 66 having horizontal flanging 67 (FIG. 13) extending laterally from each side of the web. The flanging tapers from a substantial width in the central region, between the two steering arms, to a relatively narrow width where the arm overlies the pads 64. Each side frame has a pedestal opening between pedestal jaws 68 (FIG. 14) which straddles the journal box assembly and is restrained thereon by cooperation with the interior surfaces 69 of flanges 62, in the manner shown in FIG. 13. Each side frame 65 is provided with a generally rectangular aperture 70 (FIG. 14), the upper portion of which accommodates the end portions 72 of a truck bolster 71, and provides a seating surface for the springs 73 (in this case six are provided), which react between the side frame 65, at 74 as shown in FIG. 14, and the undersurface of the projecting end 72 of the truck bolster 71.

The bolster extends laterally of the width of the truck and provides articulated connection means between the two side frames. In this instance no tie-bar is used. The bolster ends, since they pass freely through upper portions of the side frame apertures 70, flexibly interconnect the side frames with the freedom for relative tilting movements which is characteristic of this invention. In a center part of the bolster, overlying the means 14*b* which couples the steering arms, and which does not contact the bolster 71 (see FIG. 14), there is a bowl-type receiver 75, for the car body center plate which, as will be understood by those skilled in this art, is fastened to the car's center sill, which is not illustrated. As is clear from the foregoing description, in the apparatus of this invention the coupler means (P in FIG. 1, 14 in FIGS. 5 to 9, 14*b* in FIGS. 13 to 15, and 14*c* in FIG. 16), is free for steering motions in a direction across or transversely of the truck. Thus, it is also true that lateral motion of truck parts, such as the truck bolster illustrated in FIG. 14, may occur independently of the motion of coupler means 14*b*.

To provide the resilient restraint identified as $k_e$, in the description with reference to FIGS. 1 and 2, that is the restraint between the truck and the car body, a pair of elastomeric pads 76,76 are carried, at spaced portions of the upper surface of truck bolster 71, being held there in any desired manner, and are cooperable with the car bolster (not shown) which forms part of the sill structure. The function of these pads will be understood without further description. It should also be understood that a less suitable, but in some cases adequate, yaw restraint of the truck bolster can be provided by a conventional center plate and side bearing arrangement.

In considering the third and fourth structural embodiments of the invention illustrated in FIGS. 16 through 25, it should be emphasized that in these figures the invention is shown as applied by retrofitting the well-known AAR truck, which, per se, is shown in FIGS. 26–28 labelled "Prior Art".

This known truck will first be described. It comprises a pair of wheelsets including axles 100 and 101 each having fixedly mounted thereon a pair of flanged wheels 102 and 103. Like the apparatus shown in FIGS. 13–15, a cross bolster 104 is embodied in the truck, and imposes the weight of the car upon a pair of spaced side frames 105 and 106. The bolster in such a known truck is flexibly associated with the two side frames; and with the exception of the brake beams 107, serves as the only interconnection between the two frames. The brake beams do not, of course, serve as structural members between the side frames since their ends are loosely received within support fittings E carried by the side frames.

In certain of the standard trucks, a part (throughrod) of the brake rigging here indicated purely diagrammatically at 108 extends through one of the apertures 117 fore and aft of the bolster.

As appears in FIG. 27, the truck side frames have considerable depth in their mid-region. They are defined by a vertically extending web which has a large, generally rectangular aperture 109 and an upper, generally horizontal web or surface 110 (FIG. 26), extending laterally to each side of the central portion of the side frame and terminating in downwardly opening pedestal jaws 111 which straddle the axle journal bearing assembly 112. The latter, in conjunction with bearing adapters 113, serves to mount the wheelsets in known manner. The bearing adapters are of known type, also useable with minor modification in the retrofitted structure presently to be described. As will then be shown and described in detail, such adapters have slots, or keyways, within which are received flanges F (FIG. 27) which serve to position the adapter, and its bearing 112, with respect to the pedestal jaws 111.

Extending between the confronting apertures 109 of the two side frame members is the mentioned bolster 104. Its outboard ends 114 are of considerable width and limited height. The width is such that said outboard ends substantially span the width of the apertures 109, and each such bolster end extends through a corresponding aperture (one appears in FIG. 27) to a position in which it projects beyond its associated side frame (105, as illustrated in FIG. 26). The height of each outboard end is such that the springs 115, which are seated upon the lower wall structure which defines aperture 109, lie beneath the outboard bolster portion 114 and support the same with freedom for some vertical travel under the imposed load.

The bolster 104 is of considerable depth in the mid-region between the side frames (see FIG. 28), and the above-described association of its ends 114 with the side frames interconnects the side frames with limited freedom for relative movements. This bolster mid-region of considerable depth appears at 116 in FIG. 28, which figure also shows that this region of the bolster is provided with several apertures 117, sized and positioned to accept the "rod-through" brake rigging which is conventionally used in such prior art trucks, i.e., the rigging parts above referred to and diagrammatically indicated at 108. In the center of the upper surface of the bolster is the bowl-type receiver 118 which supports the center plate 119 of the car body, shown fragmentarily at 120 (FIG. 28). Reinforced pad means 121,121 are spaced across the upper surface of the bolster, and are provided to receive side bearing rollers (not shown) which contact a surface (not shown) carried by the body bolster normally provided on the under-structure of the car. A wedge W, of common type, fits within the bolster end 114 (FIGS. 27 and 28), being urged upwardly by a spring 115*a*, which is smaller than the springs 115.

As noted above, it is such a truck which is now in common freight use on United States' railroads, and it is to be understood that in such trucks, notwithstanding liberal clearances in the fit of the bearing adapter in the pedestal jaws and between the bolster and side frames, the wheelsets are constrained to be generally parallel. Thus, both axles cannot assume a position radial to a curved track and the flanges of the wheels strike the rails at an angle. These trucks are, therefore, subject to all the difficulties and disadvantages fully considered earlier in this description. As noted, some efforts have been made to redesign such trucks in order to allow the axles to assume positions substantially radial of a curved track. However, such efforts have not, prior to this invention, attempted retrofitting to facilitate steering. In fact most such redesigned trucks have lacked stability at speed. Primarily, this has been because of the lack of recognition in the art of the importance of providing certain resilient, lateral restraints which I have found to be required to prevent high speed hunting, and which also serve to enhance curving.

It is an important aspect of my invention that such a known truck may readily be retrofitted to incorporate resilient steering structures of this invention, which provide proper curving and the essential stability. As will be understood from the following description of FIGS. 16 to 22, it has been found possible to accomplish such retrofitting without requiring any modification of several major truck parts, such as wheelsets, bolster and side frames (as shown below, it may in certain embodiments be desirable to make minor changes in the pedestal area of the side frames), and, by the relatively simple addition to the truck of steering arms and resilient structure of the kind characteristic of this invention.

In accordance with one aspect of the invention, there is provided a method of retrofitting a railroad truck having constrained wheelsets with mechanism providing for coordinated steering of the wheelsets. This method, which is described just below, is practiced in the retrofitting of the AAR truck (FIGS. 26–28), to provide the trucks of FIGS. 16–22 and FIGS. 23–25, the constructional features of each of which will be described later in this disclosure. The retrofitting method is briefly described as follows:

An existing truck is selected having load-carrying side frames with opposed pairs of pedestal jaws, within which are received the usual axle bearings and bearing adapters, the latter having load-carrying connections with the side frames, and being movable with respect to the side frames independently of the other wheelset;

a generally C-shaped steering arm is applied to each wheelset;

connections are established between the adapters and free arm portions of the steering arms, with each adapter interpositioned between its corresponding bearing and pedestal jaw, to thereby provide for conjoint motion of each pair of adapters and its wheelset;

the steering arms are pivotally interconnected between the wheelsets, to exchange steering forces between the latter and to provide for coordinated pivotal steering motions of the two wheelsets; and yielding steering motion restraining means is introduced in load transmitting position between the bearing adapters and the base ends of the pedestal jaws.

When retrofitted in this manner, the truck is capable of smooth, quiet self-steering, while maintaining stability at speed, and has the physical characteristics shown, for example, in FIGS. 16–22, except that the brake equipment may be unmodified, if desired, and remain as shown in FIGS. 26–28.

Now with detailed reference to FIGS. 16–22, it should be noted that considerable structure shown in those figures also appears in FIGS. 26–28, discussed above, as will now be understood, and similar parts are, therefore, shown identified in FIGS. 16–22 with similar reference numerals. First with reference to FIGS. 16 and 17, it will be seen that the structure, after retrofitting, is provided with a pair of steering arms 122 and 123, (compare the steering arms 12 and 13 of the embodiment of FIG. 5 and the steering arms **12*b* and 13*b* in the embodiment of FIG. 13), through which the vehicle weight derived from the side frames is imposed upon the axle bearing assemblies, in the manner to be described. Each axle has a substantially fixed angularity with respect to its generally C-shaped steering arm, as is the case with the embodiments described above. As will become clear, the steering arms are coupled in a common region between the two axles. The coupling means here employed bears the designation 124 (see FIGS. 16 and 18**) and, as is the case with the other embodiments, it couples the steering arms with freedom for relative pivotal movement, preferably with stiffness against lateral motion in the general direction of axle extension.

In this retrofit embodiment of the invention, the coupling means for interconnecting the steering arms is disposed slightly to one side of the vertical centerline of the bolster 104, in order that it may pass freely through one of the apertures 117 in the bolster, the other aperture 117 being used, in most cases, for a conventional brake rod.

Figure 16:
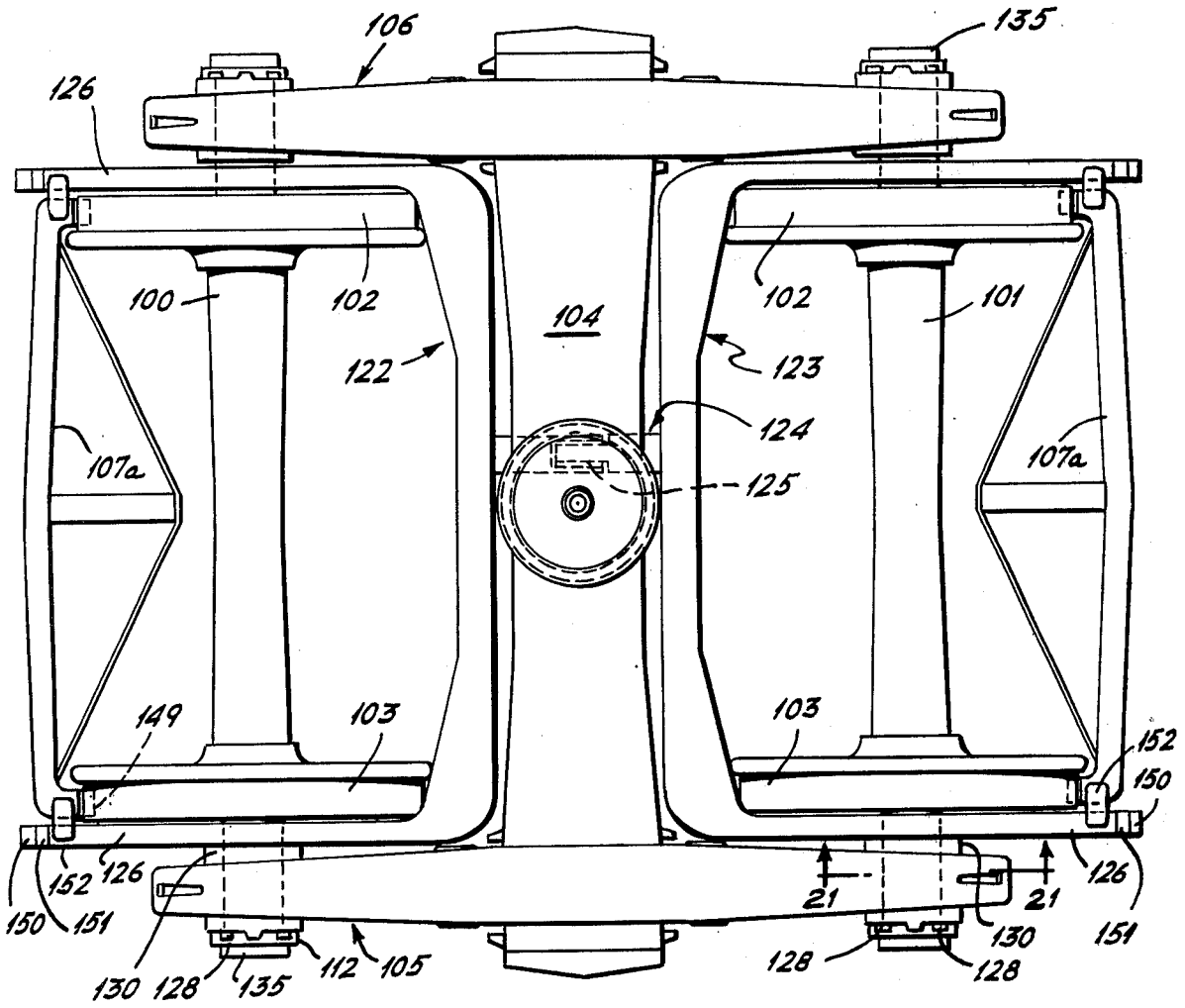

Lateral forces between the two axles are exchanged through the coupling 124, and this coupling has a lateral stiffness which may also make a contribution to the yaw stiffness between the two axles. As was the case with the other embodiments, the coupling provides for coordination and balancing of steering moments between the two axles, as well as providing the lateral stiffness. Coupling 124 may be and preferably is of the type shown in FIG. 15, i.e., of the type used in the embodiment of FIGS. 13 and 14. However, the coupling is located differently than is the corresponding coupling of FIGS. 13 and 14. In the case of the retrofitted embodiment of FIGS. 16–22, the coupling passes through an aperture 117 (FIG. 18), which is provided in the bolster, and is located somewhat off center, rather than in the center as it appears in FIGS. 13 and 14. Specific description of the coupling 124 need not be repeated, (compare coupling shown at **14*b* in FIG. 15), other than to record the fact that elastomeric material 125, preferably rubber, is interposed between the telescoped members which define the coupling, and that a corresponding one of said telescoped members is fixed to each of the steering arms 122 and 123, as shown in FIG. 16. Thus, as was the case with preceding embodiments, the coupling 124, through which the steering moments are exchanged, has considerable lateral stiffness and an angular flexibility sufficient so that the two axles are free to assume positions radial of a curved track and free to adjust to track surface irregularities. As will be understood, it is important that this coupling pass freely and with clearance through the bolster so that it may be free for steering motions in a direction across or transversely of the truck and also that lateral motion of the truck parts, such as the bolster, may occur independently of the motion of coupling means 124** and its associated steering arms. Considered from another point of view, it will be seen that the construction is of such a nature that the coupling means and the associated steering arms are not affected by centrifugal forces transmitted to the bolster.

Turning now to the manner in which each axle is associated with its steering arm, and the latter with the side frames, it will be seen, particularly from FIGS. 19–22, that each steering arm, for example the steering arm shown at 122 (FIGS. 16 and 17), has a pair of spaced free end portions 126 which extend longitudinally of the truck in planes lying between the truck wheels, and the adjacent side frame. Each of these end portions is rigidly coupled to a bearing adapter 127 through the agency of high strength bolts shown in FIGS. 16 and 17 at 128, and which appear to best advantage in FIGS. 19 and 20. Provision of apertures 129 in the bearing adapter 127 (FIG. 19) suitable to receive the bolts, is a step characteristic of the preferred retrofitting procedure. A boss 130 is provided on each steering arm, in a position to confront the bearing adapter 127, and the aforesaid bolts extend through the boss. In such a construction, the usual bearing adapters are used, in effect, as extensions of the steering arms, which extensions are interposed between the side frame and the bearing assembly carried between the pedestal jaws of such side frame. The adapters move with the steering arms, and with respect to the side frames during axle steering.

Figure 17:
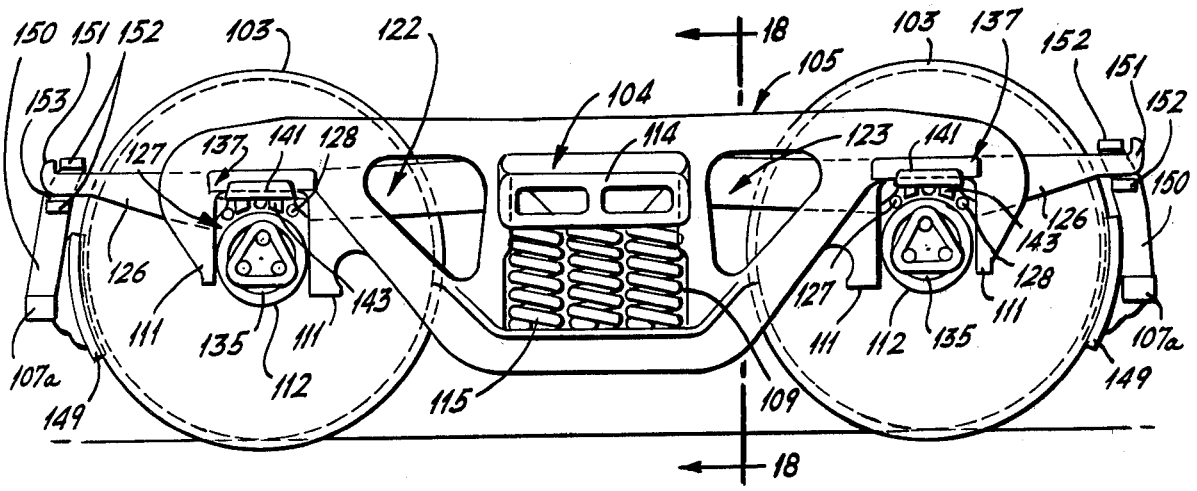

As clearly appears in FIGS. 17 and 19, and as is the case in the illustrations of the AAR truck in FIGS. 26–28, the pedestal jaws shown at 111 are sized to receive the bearing assembly 112, the upper surface of which fits within a partially cylindrical downwardly presented surface of the bearing adapter 127 (FIG. 21). The bearing adapter has a substantially flat upper surface 131, as shown in FIGS. 19 and 20, while its lower surface is partially cylindrical as noted just above. The cylindrical, bearingreceiving surface has spaced arcuate flanges 132—132 which serve to axially locate the bearing assembly 112 with respect to the adapter, and to maintain the parts, in proper assembly. In this structure, the bearing adapter is provided with spaced keyways 133—133 shaped to receive, with some clearance, the projecting flanges 134—134 provided on the inward confronting surfaces of the pedestal jaws 111, as clearly appears in FIG. 21. Cooperation between these flanges and the keyways serves to position the bearing structure, and accordingly the wheelset, laterally with respect to the load-imposing side frames, while permitting freedom for wheelset steering motions. An end cap 135 (FIGS. 16 and 17) is bolted to the end of the axle and completes the assembly of bearing and axle.

As will be plain from the earlier description of the retrofitting method, each adapter 127, carried by its steering arm, is interpositioned between its corresponding bearing assembly 112 and the overlying surface 136 (FIG. 21) of the pedestal jaw, to thereby provide for pivotal steering motion of each wheelset and consequent sliding motion of each adapter with respect to the side frame. As is characteristic of this invention, yielding pivotal motion restraining means is introduced in load transmitting position between the bearing adapters 127 and the overlying surfaces 136 which define the base ends of the pedestal jaws.

Thus, in accordance with my invention, elastomeric material is interposed between the weight-carrying side frames and the bearing adapters which, in turn, form part of the steering arms, as will now be understood. In this manner, consistent with the embodiments already described, the elastomeric means flexibly restrains yawing motions of the coupled pair of wheelsets, i.e., provides restraint of the steering motions of the axles with respect to each other and thus restrains departure of the subtrucks (comprising the steering arms and their axles) from a position in which the wheelsets are parallel. This restraining means may, if desired, be provided only at the ends of that axle which is more remote from the center of the vehicle. However, it is frequently desirable to provide such restraint at the ends of each axle. Accordingly, the embodiment of FIGS. 16–17 shows restraint at each axle. It can, of course, be of different value at each axle, depending upon the particular truck design.

As best seen in FIGS. 17, 21 and 22, the restraining means takes the form of the elastomeric pad assemblies 137 (FIGS. 21 and 22), which are interposed between the upwardly presented flat surface 131 of each bearing adapter and the confronting lower surface 136 of the outboard end portions of each side frame, in the pedestal area of the latter. The assemblies 137 comprise an elastomeric, preferably rubber, pad 138 sandwiched between thin steel plates 139 and 140 and bonded thereto. The upper plate 139 has spaced flanges 141 and 142 (FIG. 22), between which is received the portions of the side frame which extend just above the flat surface 136 of the pedestal opening. This will be readily appreciated by reviewing FIGS. 21 and 22 in the environmental showing of FIG. 17. The lower plate 140 has oppositely directed flanging 143 at each end, interrupted at 144, to receive the tongues 145, projecting from the adapter, as shown in FIG. 19. The adapter, shown in perspective in that figure, has two such tongues extending from the upper portion of the adapter. When the parts are assembled (FIGS. 17 and 20), the pad assembly 137 lies upon the surface 131 with the tongues 145 fitted within the openings 144 provided in the flanging 143 of the lower plate 140. The flanges 141 and 142 of upper plate 139 serve, of course, to locate the pad assembly with respect to the side frame, as is seen in FIG. 17. As will now be understood, the pad assembly is so located and restrained, with respect to other elements of the structure, that the elastomeric pad 138 is subjected to shear forces when the wheelsets tend to pivot, thereby providing the desired restraint and stability at speed.

Reference is now made to FIGS. 23 through 25 in which there is illustrated a modified retrofit arrangement in which the usual bearing adapter may be associated with the steering arm, to move therewith, without being bolted to the latter. In these figures, parts similar to those shown in FIGS. 19–22 bear similar reference numerals including the subscript a.

In this apparatus, the adapter 127*a* requires no drilled apertures, such as those shown at 129 in FIG. 19, being held to the steering arm 122*a* through the agency of a specially configured elastomeric pad assembly 137*a* which may be secured, conveniently by bolting, to the steering arm. This pad assembly is shown in FIG. 25, and comprises upper and lower plates 139*a* and 140*a*, respectively, between which is bonded a block of suitable resilient material 138*a*, for example rubber. As was the case with the earlier embodiment, the lower plate has opposed flanging 143*a* which span the width of the adapter and cooperate with its projecting tongues 145*a*, to position the adapter, and its axle-carrying bearing 112*a* with respect to the pad assembly.

Assembly 137*a* has a pair of tabs 146, each of which is drilled at 147. When the parts are assembled, these apertured tabs underlie the steering arm 122*a* in the manner most clearly shown in FIG. 23, from which the upper plate 139*a* has been omitted, in order that the cooperation between the adapter flanging 145*a* and the flanging 143*a* of the lower plate 140*a*, may not be obscured. Bolts 148 project through apertures provided in the steering arm and secure the arm to the tabs 146 of the lower plate. In this manner, the adapter is coupled to the steering arm through the interposed pad assembly. When the equipment is in use, as will now be understood, the side frame (not shown) lies upon the upper plate 139*a*, being received between its flanges 141*a* and 142*a*, thus to impose the load of the vehicle upon the steering arms and axles through the pads and adapters.

From the foregoing, it can readily be seen in what relatively simple manner the AAR truck may be retrofitted, by the addition of coupled steering arms and elastomeric restraining means in accordance with this invention. While such a truck may be retrofitted without effecting any change in the side frames, the axles may achieve radial position in somewhat sharper curves if the two side frames are modified to increase slightly the distance between the pedestal jaws 111, thereby to provide increasing clearance for longitudinal movement of the bearing assemblies, and the bearing adapters carried thereby, in the direction of the length of the side frames. Curving performance will also be enhanced if longitudinal stops S (see FIG. 21) are added along the outer edge of each pedestal opening to prevent the elastomeric pads 137 from migrating outward under the influence of repeated brake applications.

In retrofitting an existing truck in the manner shown in FIGS. 20–22, the wheelsets should be inspected, particularly for matched wheel sizes and to remove any rolledout extensions of the tread which might contact the steering arms. Also, it should be determined that the openings in the bolster 104 contain no casting flash which might interfere with the free movement of the steering arm coupling 124. In addition, it is important that the two side frames be of the same wheelbase, or "button" size, if these conditions are met, no difficulty should be encountered in accomplishing the retrofit.

While it is possible to use standard AAR brake rigging, as shown in FIG. 26, with a retrofitted truck of the kind shown in FIGS. 16–18, (care being taken to ensure that rigging is so positioned as not to interfere with the free movement of the coupling 124) the retrofitted embodiment lends itself well to the improved braking which is described below with reference to FIGS. 7, 8 and 8*a*.

Making detailed reference to the unique braking apparatus characteristic of the invention and to the advantages which are achieved thereby. In prior brake apparatus commonly used in the railroad art, the brake beam is supported by an extension member which rides in a slot in the truck frame. This system has several substantial drawbacks. The friction created at the slot interferes with precise control of the force between the wheel tread and the brake shoe, and the radial distance between the friction face of the shoe and its point of support in the slot, results in an overturning moment on the brake shoe which, in turn, causes large variations in the unit pressure between the shoe and the wheel tread, along the length of the shoe face. Another problem with conventional brake rigging is the large lateral clearance between the brake beams and the car truck side frames. With conventional trucks this clearance is required to prevent high lateral forces which would occur if the distortion of the truck framing in curves is limited by contact between the brake shoes and the wheel flanges. The above problems can combine to produce unsymmetrical wear of the two wheels in each wheelset, the one wheel having excessive flange wear, the other having excessive wear of the tread, and in some cases wear of the outside corner of the wheel leading to overheating and occasional derailment due to wheel failure.

In the braking arrangement shown in FIGS. 7, 8 and 8*a*, these disadvantages are overcome, primarily because the association of the brake beams with the steering arms makes it possible virtually to eliminate uneven wear at the shoe and completely to prevent any contact between the shoes and the wheel flanges. Since the brake beams 24 are carried by hangers 27 which are supported in pad structures 28, formed integrally with the steering arms (instead of on the truck frames or bolster), and because of the fixed angular relationship between the wheelsets and the steering arms, the brake pads 26 always remain properly centered with respect to the wheel treads.

FIG. 8 shows how the proper choice of geometrical relationships can be used to provide two different values for the braking force B on the leading and trailing wheelsets. This compensates for the transfer of weight from the trailing to the leading wheelset during braking. Thus, providing this compensation reduces the risk of wheel sliding. The braking effect on the lead wheelset $B_L$ is made larger than the braking effect on the trailing wheelset, $B_T$, by choosing a centerline for the hanger structure 27 which is inclined with respect to a line t, which is tangent to the wheel surface at the center of the brake shoe face. Referring to the two force polygons which comprise FIG. 8*a*, it can be seen that the effect of the mentioned angle is to create an angle between the vectors $R_L$ and $B_L$, and the vectors $R_T$ and $B_T$. The presence of these angles causes the normal force $N_L$, between the shoe and the lead wheel, to be larger than the force $N_T$ between the shoe and the trailing wheel. It is necessary to have the same ratio between the normal forces N and the braking forces B, for both wheelsets, and the ratio is established by the coefficient of friction chosen for the brake shoe material and the steel face of the wheel.

The total force applied to the brakes is shown in the drawings by arrows appearing on the brake beam linkage in FIGS. 7 and 8. As shown by the force polygon, the braking force applied to the beam linkage at the leading, or right hand, wheelset is $F_2$, while the force applied to the linkage at the trailing wheelset, is represented in the polygon as the equal and opposite $F_1$. Since two brake shoes are actuated by each beam assembly, the arrow showing brake actuator force is labeled on the trailing wheelset as amounting to $2F_1$. As will be understood, this force can be supplied by any convenient conventional means, including for example, a connection extended through an aperture through the bolster such as the aperture 117 through which the conventional "through-rod" 108 previously extended. Such connection serves adapted to apply the force in the direction of the arrows shown on the center strut of the brake beam structure.

In retrofitted trucks spaced steering arm extensions 126 may extend outwardly of each end of the truck a distance sufficient to provide for application of the brakes at the outside surfaces of the wheels of each wheelset. These are the surfaces which, at any instant, are, substantially, the furthest removed from the center of the truck as measured in the direction of the truck travel. Such extensions have been incorporated in the embodiment of FIGS. 16 and 17 and it will be seen that the brakes 149 are fixedly carried by downwardly extending brake arms 150 which have special configuration to couple them pivotally to free, upwardly hooked, ends 151 of the extensions 126. This configuration is such that the upper end of each brake arm 150 is provided with a pair of vertically spaced flanges 152 which form a slot 153 (left side of FIG. 17) within which is received the steering arm extension 126 and its hooked end 151.

As is the case with the brake structure described above with respect to FIGS. 7, 8 and 8*a*, the brake beams 107*a* extend between and are associated with the shoe mounting structure in such manner that the position of each brake is fixed with respect to its corresponding wheel. This prevents brake misalignment and flange wear problems which characterize the prior art brake rigging in which the beams are carried by the side frames. Apparatus for actuating the brakes would, of course, be provided. This apparatus would serve to displace the brake beams 107*a* and 107*a*. The brake apparatus of FIGS. 16 and 17, like that shown in FIGS. 7, 8 and 8*a*, substantially reduces brake shoe wear and results in much safer braking.

In summary, the apparatus shown in the several embodiments of the invention based, as it is, on recognition of the important part played by control of yaw and lateral stiffness, virtually eliminates flange contact in curves and greatly reduces flange forces when contact does occur. In addition, excellent high speed stability is achieved, with resultant minimization of wear and cost problems. As will now be understood, these advantages are achieved by providing restraining means between the side frames and the steering arms of a truck, to restrain yawing motion of the axles, by having the steering arms coupled through further restraining means, and by providing suitable restraining means between the side frames, or their associated bolster, and the body of the vehicle. Use of equal restraint between the side frames and the steering arms at each side, e.g. the four pads 30 in the embodiment of FIGS. 5 and 6, has the advantage of minimizing parts inventory and simplifying assembly and maintenance. Use of unequal restraint, which in some instances can be done by eliminating restraining pads at one axle, can further improve the radial steering action desired during curving.

With especial reference to the apparatus of FIGS. 16–28, it will be readily understood in what simple manner existing prior art trucks may be retrofitted to achieve the advantages of this invention.

Limiting the side frame car body forces, as for example by the use of a tow bar, such as shown in FIG. 5, is highly advantageous for reasons which will now be understood.

The invention has been analyzed mathematically, and illustrated schematically, as well as being shown and described with reference to several structural embodiments. While the emphasis herein has been on the use of elastomeric restraints, similar advantages can be achieved by the use of resilient steel springs. The use of elastomeric restraints, however, has the advantage of simultaneously providing side-frame-to-car-body elasticity, while also providing both vertical and lateral flexibility in the suspension.

In general, however, it will be understood that the use of steel restraints, or of such other structural modifications as properly come within the terms of the appended claims, are within the scope of this invention.

I claim:

1. A vehicle truck assembly, comprising: main truck framing including bolster means for load-bearing association with a wheeled vehicle, and a pair of side frame members each associated with a corresponding end portion of said bolster means to receive load therefrom, and each having means defining a pair of pedestal members for loadimposing cooperation with outboard axle portions of a wheelset; bearing means for each outboard axle portion, each such bearing means being in load-carrying association with a corresponding pedestal member; a pair of steering arm means each having spaced portions connected to corresponding bearing means, whereby each carries an axle-borne wheelset, and each steering arm means having structure extending into a region between the two axles; means in said region extending through an opening through said bolster means and pivotally interconnecting the steering arm structures independently of yaw-inducing connection with said bolster means; and resilient means interposed between the bearing means of at least one axle and its corresponding pedestal members, said resilient means being of stiffness sufficient resiliently to oppose departure of said pivotally connected steering arm means from positions in which the wheelsets are parallel.

2. A truck assembly in accordance with claim 1 and further characterized in that each bearing means includes an axle-engaging bearing and a bearing adapter disposed to impose load upon said bearing, said resilient means being interposed between the bearing adapter and its corresponding pedestal member.

3. A truck assembly in accordance with claim 2, and in which said resilient means comprises a block of elastomeric material having metallic sheets secured to opposite surfaces thereof, one sheet being disposed in contact with and linked to said bearing adapter and the other sheet being disposed in contact with and linked to said pedestal member.

4. A truck assembly in accordance with claim 2, and including: means linking each bearing adapter to a corresponding resilient means; and means securing each resilient means to a corresponding spaced portion of said steering arm means.

5. A truck assembly in accordance with claim 2, and including means removably securing the bearing adapters to corresponding spaced portions of said steering arm means.

6. A truck assembly in accordance with claim 5, and in which said last mentioned means comprises members extended within said adapters and steering arm means and threadedly effecting such securement.

7. A truck assembly in accordance with claim 5, and in which said resilient means comprises a block of elastomeric material having metallic sheets secured to opposite surfaces thereof, one sheet being disposed in contact with said bearing adapter and the other sheet being disposed in contact with said pedestal member.

8. Apparatus in accordance with claim 2, in which said resilient means comprises pads of elastomeric material, each pad sandwiched between metal sheets, with one metal sheet linked to and supported by a surface of said bearing adapter, and the other metal sheet disposed in loadbearing relation with one of said pedestal members and fixed to said steering arm means.

9. Apparatus in accordance with claim 8, in which said other metal sheet is bolted to said steering arm means.

10. A vehicle truck assembly, comprising: main truck framing including bolster means for load-bearing association with a wheeled vehicle and having an aperture therethrough in a region generally centered with respect to the width of the truck, and a pair of side frame members each associated with a corresponding end portion of said bolster means to receive load therefrom, and each having means defining a pair of pedestal members for load-imposing cooperation with outboard axle portions; bearing means for each outboard axle portion, each such bearing means being in load-carrying association with a corresponding pedestal member; a pair of steering arm means each having spaced portions connected to corresponding bearing means, whereby each carries an axle-borne wheelset, and each steering arm means having structure extending into a region between the two axles; means in said region extending through the aperture of said bolster means while maintaining clearance with respect to said bolster means and resiliently pivotally interconnecting the steering arm structures independently of yaw-inducing connection with said bolster means; and resilient means interposed between the bearing means of at least one axle and its corresponding pedestal members, said resilient means being of stiffness sufficient resiliently to oppose departure of said pivotally connected steering arm means from positions in which the wheelsets are parallel.

11. In a railway vehicle, truck: at least two load-carrying axles, movable to different relative angularities in a horizontal plane, each of said axles having a pair of spaced-apart flanged wheels mounted thereon and adapted to transmit weight from the axle to the track on which the wheels roll; a pair of steering arms, one for each of said two axles, each steering arm having means for mounting its associated axle, and having in relation to its associated axle a substantially fixed angularity in a horizontal plane, and each steering arm extending from its associated axle to a region between said two axles; means in said region providing pivotal connection between the steering arms for transmitting forces between the axles; framing spanning the two axles in outboard regions of the latter and transmitting vehicle weight to the steering arms and thence to the axles; a brake disposed for cooperation with the tread surface of each wheel of each axle, said surfaces being those surfaces which, at any instant, are, substantially, the furthest removed from the center of the truck as measured in the direction of truck travel; brake beam means for applying the brakes for the wheels of each axle to the tread of each associated wheel; and means preventing movement of the brakes in the direction of axle extension, whereby separation between the brakes and the wheel flanges is maintained, said last means comprising structure supporting said brake beam means from the steering arm which supports the corresponding axle.

12. A railway vehicle truck in accordance with claim 11, and further characterized in that each steering arm is generally C-shaped, when viewed in plan, and has free end portions extending beyond said means for mounting its associated axle toward the region of one end of the truck, said brake beam means carrying the brakes and being supported from said free end portions.

13. In combination with a railway vehicle, a truck assembly comprising: a pair of side frames; a bolster spanning said side frames and movably associating the latter in loadbearing relation with the railway vehicle; a pair of subtrucks each carrying an axle-borne wheelset with bearing means toward each end of the axle, each said subtruck having a portion extending from its wheelset to a region between the two axles and confronting opposite side portions of said bolster; means extending through said bolster and resiliently pivotally interconnecting said subtrucks for conjoint steering motions of the latter, independently of yaw-inducing connection with said bolster; and resilient means coupled to at lease one subtruck and disposed resistively to react between said side frames and the axle bearing means of said one subtruck, in response to departure of said subtrucks from positions in which the wheelsets are parallel.

14. A combination in accordance with claim 13, and in which said bolster is provided with an aperture and said means interconnecting the subtrucks extends through the aperture while maintaining clearance with respect to said bolster.

15. A vehicle truck assembly, comprising: main truck framing including bolster means for load-bearing association with the axled wheel sets of a wheeled vehicle, and a pair of side frame members each associated with a corresponding end portion of said bolster means to receive load therefrom, and each having means defining a pair of pedestal members for load-imposing cooperation with outboard axle portions; bearing means for each outboard axle portions, each such bearing means being in load-carrying association with a corresponding pedestal member; a pair of steering arm means each having spaced portions connected to corresponding bearing means, whereby each carries an axle-borne wheelset, and each steering arm means having structure extending into a region between the two axles; means in said region resiliently pivotally interconnecting the steering arm structures independently of yaw-inducing connection with said bolster means; and resilient means interposed between the bearing means of at least one axle and its correpsonding pedestal members, said resilient means being of stiffness sufficient resiliently to oppose departure of said pivotally connected steering arm means from positions in which the wheelsets are parallel.

16. A vehicle truck assembly, comprising: main truck framing including bolster means fro load-bearing association with the axled wheelsets of a wheeled vehicle and a pair of side frame members each associated with a corresponding end portion of said bolster means to receive load therefrom, and each having means defining a pair of pedestal members for loadimposing cooperation with outboard axle portions; bearing means for each outboard axle portion, each such bearing means being in load-carrying association with a corresponding pedestal member; a pair of steering arm means each having spaced portions connected to corresponding bearing means, whereby each carries an axle-borne wheelset, and each steering arm means having structure extending into a region between the two axles; means in said region resiliently pivotally interconnecting the steering arm structures while maintaining clearance with respect to said bolster means and independently of yaw-inducing connection with said bolster means; and resilient means interposed between the bearing means of at least one axle and its corresponding pedestal members, said resilient means being of stiffness sufficient resiliently to oppose departure of said pivotally connected steering arm means from positions in which the wheelsets are parallel.

17. A railway car truck, including a standard bolster, having transverse openings for rod through brake rigging, resiliently supported on spring groups in side frames between spaced vertical columns thereof, a pair of longitudinally spaced wheelsets composed of axles with spaced apart wheels fixed thereon, the wheelsets being mounted on opposed ends of the side frames, a pair of "U" shaped steering arms each with a cross beam and two side arms connected with its cross beam, each pair of side arms on each steering arm having portions at their free ends extended to a position above the associated axle and being mounted on the axle and further being extended from its associated wheelset to a point intermediate the axles and each cross beam having a connecting post offset downwardly below said free end portions of the side arms, the sterring arms being contoured so that they remain clear of the side frames, wheels and bolster to permit access to the brake beam head and brake shoe and place said cross beams at a position clear of the brake beam and of the structure of the car and position the connecting posts in a position laterally of the truck to prevent interference with one of the standard bolster brake rod openings, while passing through another opening for interconnection with the mating steering arm, and the connecting posts having members slidable interengaging each other and angularly moveable with respect to each other to provide for angling articulation of the two steering arms and the associated wheelsets.

* * * * *